US007140398B2

(12) United States Patent
Dodge et al.

(10) Patent No.: US 7,140,398 B2
(45) Date of Patent: Nov. 28, 2006

(54) SPORTS EQUIPMENT HAVING A TUBULAR STRUCTURAL MEMBER

(75) Inventors: David J. Dodge, Williston, VT (US); William C. Doble, Essex Junction, VT (US)

(73) Assignee: Alliance Design and Development Group, Inc., Essex, VT (US)

( * ) Notice: Subject to any disclaimer, the term of this patent is extended or adjusted under 35 U.S.C. 154(b) by 563 days.

(21) Appl. No.: 10/351,307

(22) Filed: Jan. 27, 2003

(65) Prior Publication Data

US 2003/0144071 A1 Jul. 31, 2003

Related U.S. Application Data

(60) Provisional application No. 60/352,296, filed on Jan. 28, 2002.

(51) Int. Cl.
*F16L 9/00* (2006.01)
*A63B 53/00* (2006.01)

(52) U.S. Cl. ..... 138/177; 138/172; 138/174; 473/316; 473/323

(58) Field of Classification Search ..... 138/177, 138/178, 172, 174, 118; 473/323, 316
See application file for complete search history.

(56) References Cited

U.S. PATENT DOCUMENTS

| | | | | |
|---|---|---|---|---|
| 3,300,226 | A | 1/1967 | Reed, Jr. | 280/602 |
| 3,461,593 | A | 8/1969 | Martuch | 43/18.5 |
| 3,833,219 | A | 9/1974 | Dean | 473/523 |
| 4,105,205 | A | 8/1978 | Theodores et al. | 473/523 |
| 4,221,400 | A | 9/1980 | Powers | 280/602 |
| 4,358,113 | A | 11/1982 | McKinnon et al. | 473/561 |
| 4,592,567 | A | 6/1986 | Sarter | 280/602 |
| 5,381,782 | A * | 1/1995 | DeLaRama et al. | 600/149 |
| 5,409,216 | A | 4/1995 | Brown | 473/552 |
| 5,879,250 | A | 3/1999 | Tahtinen et al. | 473/561 |
| 6,113,508 | A | 9/2000 | Locarno et al. | 473/176 |
| 6,257,997 | B1 | 7/2001 | Doble et al. | 473/516 |
| 6,520,867 | B1 * | 2/2003 | Miura et al. | 473/316 |
| 2005/0079925 | A1 * | 4/2005 | Cheng et al. | 473/316 |

FOREIGN PATENT DOCUMENTS

FR 1526418 5/1968

* cited by examiner

*Primary Examiner*—Patrick Brinson

(57) ABSTRACT

A tubular structural member that provides directional resistance. The tubular structural member has a flexural resistance that is greater in one direction than in another. The tubular structural member can be employed in variety of devices or structures so as to effect the overall stiffness of the device.

12 Claims, 32 Drawing Sheets

295

296

SPORTS EQUIPMENT HAVING A TUBULAR STRUCTURAL MEMBER

We claim priority under 35 USC 119. This application is based on Provisional Application No. 60/352,296 filed on Jan. 28, 2002.

BACKGROUND OF THE INVENTION

1. Field of the Invention

The present invention relates to devices and methods for constructing tubular structural members. The tubular structural members can control the stiffness of various devices and structures. The present invention can be used with any type of sports equipment where the user will find it desirable to adjust or change the stiffness of the device, such as hockey sticks, lacrosse sticks, field hockey sticks, bats (for baseball, softball or cricket), golf clubs, fishing rods, skis, snowboards, pole vaulting poles, polo mallets, footwear, masts, scuba fins, bicycles, weightlifting devices, and oars. The invention also relates to methods of manufacturing these devices so that the desired stiffness may be set at the time of manufacture.

2. Description of Related Art

Adjustable sports equipment is known from U.S. Pat. No. 6,113,508 and U.S. Pat. No. 6,257,997 B1 that have a cavity in which a stiffening rod is inserted. The use of a stiffening rod, called a structural member, is taught into these references. The cross-section of the structural member can vary along its length with respect to its cross-sectional moment of inertia or plane of flexural resistance. Stiffness then becomes a function of the desired stiffness characteristic of the material or materials at that location and the arrangement of those materials. The present application incorporates disclosure of U.S. Pat. Nos. 6,113,508 and 6,257,997 B1, by reference.

In recent years, sports equipment manufacturers have increasingly turned to different kinds of materials to enhance their sporting equipment. In so doing, entire lines of sports equipment have been developed whose stiffness or flexibility characteristics are but a shade different from each other. Such a shade of difference, however, may be enough to give the individual equipment user an edge over the competition or enhance sports performance.

The user may choose a particular piece of sports equipment having a desired stiffness or flexibility characteristic and, during play, switch to a different piece of sports equipment that is slightly more flexible or stiffer to suit changing playing conditions or to help compensate for weariness or fatigue. Such switching, of course, is subject to availability of different pieces of sports equipment from which to choose.

That is, subtle changes in the stiffness or flexibility characteristics of sports equipment may not be available between different pieces of sports equipment, because the characteristics have been fixed by the manufacturer from the choice of materials, design, etc. Further, the user must have the different pieces of sports equipment nearby during play or they are essentially unavailable to the user.

Turning to various types of sports, it can be seen how the lack of adjustability in stiffness and flexibility may adversely affect optimum performance of the player.

Hockey

Hockey includes, but is not limited to, ice hockey, street hockey, roller hockey, field hockey and floor hockey.

Hockey players may require that the flexure of the hockey stick be changed to better assist in the wrist shot or slap shot needed at that particular junction of a game or which the player was better at making. Players may not usually leave the field to switch to a different piece of equipment during play.

Younger players may require more flex in the hockey stick due to lack of strength; such flex may mean the difference between the younger player being able to lift the puck or not when making a shot since a stiffer flex in the stick may not allow the player to achieve such lift.

In addition, as the younger players ages and increases in strength, the player may desire a stiffer hockey stick, which in accordance with convention means the hockey player would need to purchase additional hockey stick shafts with the desired stiffness and flexibility characteristics. Indeed, to cover a full range of nuances of differing stiffness and flexibility characteristics, hockey players would have available many different types of hockey sticks.

Even so, the hockey player may merely want to make a slight adjustment to the stiffness or flexibility of a given hockey stick to improve the nuances of the play. Such would not be possible unless the multitude of hockey sticks included those having all such slight variations in stiffness and flexibility needed to facility such nuances.

U.S. Pat. No. 6,113,508 reveals the use of a stiffening rod in cavities of a shaft of a hockey stick to permit the user to adjust the stiffness of the hockey stick shaft. U.S. Pat. No. 6,257,997 reveals the use of a rotatable flexure resistance spine in cavities of a shaft of a hockey stick to permit the user to adjust the stiffness of the hockey stick shaft. U.S. Pat. No. 4,348,113 reveals insertion of juxtaposed mainstays into cavities of a shaft of a hockey stick to help make the stick withstand excessive damage resulting from wear caused by abrasion as the butt side of the hockey blade scrapes or hits the ice. U.S. Pat. No. 5,879,250 reveals insertion of a core into a shaft of a hockey stick to help the stick stronger and more durable to withstand high strains during the course of play. A series of grooves are formed in the core in an attempt to attain a desire center of equilibrium.

Tennis

Tennis players also may want some stiffness adjustability in their tennis rackets and to resist unwanted torsional effects caused by the ball striking the strings during play. The torsional effects may be more pronounced in the case where the ball strikes near the rim of the racket rather than the center of he strings. Thus, it would be desirable to lock in the stiffness characteristic close to the rim as opposed to just at the handle end.

U.S. Pat. No. 6,113,508 reveals the use of a stiffening rod in cavities of a shaft of a tennis racquet to permit the user to adjust the stiffness of the tennis racquet. U.S. Pat. No. 6,257,997 reveals the use of a rotatable flexure resistance spine in cavities of a shaft of a tennis racquet to permit the user to adjust the stiffness of the tennis racquet.

U.S. Pat. No. 4,105,205 reveals one or more rotatable beams of rectangular cross section arranged within a cavity of the tennis racket for radically changing its stiffness. U.S. Pat. No. 5,409,216 reveals a shaft in the form of a double head ends for improving the grip on the handle, which may change the stiffness or flexibility of the racket due to a change in orientation of the double head ends relative to the racket head. U.S. Pat. No. 3,833,219 reveals spacer discs in a tennis racket, each disc having a width that exceeds its thickness. The spacer discs, if made of metal, may be made in varied weights and thickness to allow for adjusted handle weight as well as for adjusted grip sizes.

Lacrosse

Lacrosse players use their lacrosse sticks to scoop up a lacrosse ball and pass the ball to other players or toward goal. The stiffness or flexibility of the lacrosse stick may affect performance during the game. Players may tire so some adjustment to the flexibility of the stick may be desired to compensate. With conventional lacrosse sticks, such adjustment is not available.

U.S. Pat. No. 6,113,508 reveals the use of a stiffening rod in cavities of a shaft of a lacrosse stick to permit the user to adjust the stiffness of the lacrosse stick. U.S. Pat. No. 6,257,997 reveals the use of a rotatable flexure resistance spine in cavities of a shaft of a lacrosse stick to permit the user to adjust the stiffness of the lacrosse stick.

Other Racket Sports

Other types of racket sports also suffer from the drawback of being unable to vary the stiffness and flexibility of the racket during the course of play to suit the needs of the player at that time, whether those needs arise from weariness, desired field positions, or training for improvement. Such racket sports include racquetball, paddleball, squash, badminton, and court tennis.

For conventional rackets, the stiffness and flexibility is set by the manufacturer and invariable. If the player tires of such characteristics being fixed or otherwise wants to vary the stiffness and flexibility, the only practical recourse is to switch to a different racket whose stiffness and flexibility characteristics better suit the needs of the player at that time.

Golf

Golf clubs may be formed of graphite, wood, titanium, glass fiber or various types of composites or metal alloys. Each varies to some degree with respect to stiffness and flexibility. However, golfers generally carry onto the golf course only a predetermined number of golf clubs. Varying the stiffness or flexibility of the golf club is not possible, unless the golfer brings another set of clubs of a different construction. Even in that case, however, the selection is still somewhat limited.

Nevertheless, it is impractical to carry a huge number of golf clubs onto the course, most rules limit the number of clubs that can be carried to 14. But, as each club has a slight nuance of difference in flexibility and stiffness than another., golf players prefer taking onto the course a set of clubs that are suited to the player's specific swing type, strength and ability.

U.S. Pat. No. 6,113,508 reveals the use of a stiffening rod in cavities of a golf club shaft to permit the user to adjust the stiffness of the golf club shaft. U.S. Pat. No. 6,257,997 reveals the use of a rotatable flexure resistance spine in cavities of a golf club shaft to permit the user to adjust the stiffness of the golf club shaft.

Skiing, Snowboarding, Snow Skating, Skiboarding

Skis are made from a multitude of different types of materials and dimensions, the strength and flexibility of each type differing to a certain extent. Skis include those for downhill, ice skiing, cross-country skiing and water-skiing. Other types of snow sports devices include snowboards, snow skates and skiboards. Beginners generally require more flex and, as they progress in ability, much less.

Skiers generally do not carry with them a multitude of different types of skis for themselves use during the course of the day to suit changing skiing conditions or to compensate for their own weariness during the day. The same holds true for those who use snowboards, snow skates and skiboards.

U.S. Pat. No. 6,113,508 reveals the use of a stiffening rod in cavities of a ski, snowboard or snowskate to permit the user to adjust the stiffness of the ski, snowboard or snowskate. U.S. Pat. No. 6,257,997 reveals the use of a rotatable flexure resistance spine in cavities of a ski, snowboard or snowskate to permit the user to adjust the stiffness of the ski, snowboard or snowskate.

U.S. Pat. No. 3,300,226 reveals elongated bars in skis. Each bar may be rotated to a desired orientation to vary the stiffness and flexibility of the skis. The bars have a width that exceeds their thickness. U.S. Pat. No. 4,221,400 reveals the use of prestressed curved rods, which are rotated to affect the amount of camber or predetermined curve in a ski. French Patent No. 1,526,418 reveals elongated rods in skis that may be rotated to a desired orientation to vary the stiffness and flexibility of the skis. The rods surround a stiffening bar having a width that exceeds their thickness. U.S. Pat. No. 4,592,567 reveals replaceable elongated flat bars attached to the top surface of a ski as a means to affect the flexure of a ski.

Ski Boots

Cross country and telemark skiing boots attach to the ski via a binding at the toe and have a free heel that allows the skier to stride on the snow in a motion similar to walking. The boots (or shoes) have flexible soles to allow a greater range of motion. Telemark bindings have a cable that runs around the heel of the boot to provide holding power, but also acts to exert pressure from the skier into the ski. Performance in cross country and telemark skiing can be greatly affected by the amount of pressure that is exerted by the skier through the boot/shoe into the ski. Different boots have different sole stiffness that skiers use to suit their particular style and needs.

Telemark skiers further change the amount of pressure that is transmitted into the ski by adjusting the tension on the cable. More tension will result in stiffening the sole of the boots and thus increase the pressure and control that the skier has over the ski. More sole stiffness provides more pressure which is needed for more control in steeper or icier conditions. Less stiffness reduces the pressure to allow for a smoother glide and more comfort in easier, flatter and softer snow conditions. It would be desirable to allow the skier to quickly and easily change the stiffness of the boot sole and thus change the amount of pressure that is to be transmitted into the ski, thereby altering the ski performance.

U.S. Pat. No. 6,257,997 reveals the use of a rotatable flexure resistance spine into cavities of a boot to permit the user to adjust the stiffness of the boot.

Bicycle Shoes

Bicycle specific shoes are rigid and attach to bicycle pedals usually through a binding or clip mechanism that prohibits the shoe from slipping off the pedal. The shoe is positioned on the pedal so the ball of the foot is directly over the pedal. The rider's foot flexes as the pedal moves through its range of motion and the rider depends on his/her foot and ankle strength to effect additional pressure onto the pedal and thus increase the speed or power delivery.

It would be desirable to supplement the rider's own ankle and foot strength by making the sole of the shoe stiffer and increasing the leverage the rider has on the pedal. Preferably, riders will be able to adjust the stiffness of the shoe sole according to their strength, road/course conditions.

U.S. Pat. No. 6,257,997 reveals the use of a rotatable flexure resistance spine into cavities of a shoe to permit the user to adjust the stiffness of the shoe.

Running Shoes, Training Shoes, Basketball Shoes

The transmission of the shoe wearer's strength (power) from their legs into the ground is directly affected by the sole stiffness of the shoe. Runners may gain more leverage and thus more speed by using a stiffer sole. Basketball players may also affect the height of their jumps through the leverage transmitted by the sole of their shoes. If the sole is too stiff, however, the toe-heel flex of the foot is hindered.

It would be desirable that the shoe wearer have the ability to tailor the sole stiffness to his/her individual weight, strength, height, running style, and ground conditions. Preferably, the shoe wearer may tailor the stiffness of the shoe sole to affect the degree of power and leverage that is to be transmitted from the wearer into the ground.

U.S. Pat. No. 6,257,997 reveals the use of a rotatable flexure resistance spine into cavities of a shoe to permit the user to adjust the stiffness of the shoe.

Batting

Sports such as baseball, softball, and cricket use bats to strike a ball. The batter may want to select a bat that is more stiff or flexible, depending upon the circumstances of play. Conventional bats only permit the batter to choose from among a variety of bats of different weights and materials to obtain the desired stiffness or flexibility. However, adjusting the stiffness or flexibility characteristics for a given bat is not feasible conventionally. Further, there is no practical way conventionally to determine which batting flexure and stiffness is optimal for batters with a single batting device.

U.S. Pat. No. 6,113,508 reveals the use of a stiffening rod in cavities of a bat to permit the user to adjust the stiffness of the bat. U.S. Pat. No. 6,257,997 reveals the use of a rotatable flexure resistance spine in cavities of a bat to permit the user to adjust the stiffness of the bat.

Polo

Polo players use mallets during the course of the polo match. Changing the stiffness or flexibility characteristics is only available by exchanging for a different mallet with the desired characteristics.

U.S. Pat. No. 6,113,508 and U.S. Pat. No. 6,257,997 reveal the use of a rotatable flexure resistance spine into cavities of a polo mallet to permit the user to adjust the stiffness of the polo mallet.

U.S. Pat. No. 6,113,508 reveals the use of a stiffening rod in cavities of a polo mallet to permit the user to adjust the stiffness of the polo mallet. U.S. Pat. No. 6,257,997 reveals the use of a rotatable flexure resistance spine in cavities of a polo mallet to permit the user to adjust the stiffness of the polo mallet.

Sailboating and Sailboarding

Masts of sailboats and sailboards support sails, which are subjected to wind forces. These wind forces, therefore, act through the sails on the mast. The mast may be either a rigid or flexible structure, which may be more desirable under certain sailing conditions. If the mast is flexible, tension wires may be used to vary the tension of the mast. Otherwise, the flexibility and stiffness characteristics of mast are generally fixed by the manufacturer, making it impractical to alter the mast flexibility or stiffness in different directions to suit changes in wind direction or the needs of the sailor.

U.S. Pat. No. 6,113,508 reveals the use of a stiffening rod in cavities of a mast to permit the user to adjust the stiffness of the mast. U.S. Pat. No. 6,257,997 reveals the use of a rotatable flexure resistance spine in cavities of a polo mast to permit the user to adjust the stiffness of the mast.

Canoeing, Rowboating and Kayaking

Paddles for canoes, row boats, and kayaks are subjected to forces as they are stroked through water. The flexibility or stiffness of the paddles, while different depending upon its design and materials, is fixed by the manufacturer. Thus, a rower who desired to change such characteristics would need to switch to a different type of paddle. Carrying a multitude of different types of paddles for use with a canoe, row boat or kayak, however, is generally impractical for the typical rower from the standpoint of cost, bulk and storage.

U.S. Pat. No. 6,113,508 reveals the use of a stiffening rod in cavities of a paddle to permit the user to adjust the stiffness of the paddle. U.S. Pat. No. 6,257,997 reveals the use of a rotatable flexure resistance spine in cavities of a paddle to permit the user to adjust the stiffness of the paddle.

Pole Vaulting

Pole vaulters use a pole to lift themselves to desired heights. The pole has flexibility and stiffness characteristics fixed by the manufacturer. The pole vaulter must switch to a different pole if the characteristics of a particular pole are unsatisfactory.

Fishing Rods

Fishing rods are flexed for casting out a line. The whip effect from the casting is affected by the stiffness or flexibility of the rod. Depending upon the fishing conditions and the individual tastes of the user, the user may prefer the rod to be either more flexible or more stiffer to optimize the whip effect of the cast.

U.S. Pat. No. 6,257,997 reveals the use of a rotatable flexure resistance spine into cavities of a fishing rod to permit the user to adjust the stiffness of the fishing rod.

U.S. Pat. No. 3,461,593 reveals elongated inserts in a fishing rod that may be rotated or twisted to a desired orientation to vary the stiffness and flexibility of the rod. The inserts have a width that exceeds their thickness and may be configured into any of a variety of different geometric shapes.

Exercise Equipment

Users of weight resistance equipment require different levels of resistance according to the particular exercise and their level of fitness. Ease of adjusting this resistance is desirable to maximize time spent in the exercise and minimize the time spent in setting up the equipment.

U.S. Pat. No. 6,257,997 reveal the use of a rotatable flexure resistance spine in a weight resistance unit to permit the user to adjust the level of resistance.

As defined in this application, sports equipment covers any type of rod, stick, bat, racket, club, ski, board, mast, pole, skate, paddle, mallet, scuba fin, footwear, exercise machine or weight bench that is used in sports. The sports equipment flex either (1) to strike or pick up and carry an object such as a ball or puck (hockey, lacrosse, batting, golf, tennis, etc.), (2) to carry a person (pole vaulting), (3) to cast out a line (fishing rod), (4) to engage a frictional surface (such as skis or footwear against the ground, snow or water or scuba fins against the water), or (5) to respond to forces (such as the wind forces against a sail or muscular forces exerted when using an exercise machine or weight bench).

BRIEF DESCRIPTION OF THE INVENTION

The invention relates to a tubular structural member. The tubular structural member is stiffer in one plane than another.

Thus, the tubular structural member can provide a directional stiffness as a reinforcement in certain devices and structures. The tubular structural member can also be tapered from one end to the other, and can be step-tapered. The tubular structural member can be inserted into a device or structure having a cavity with an inner diameter that substantially matches the outer diameter of the tubular structural member along its length. The tubular structural member can be free to rotate within the cavity, or affixed permanently or temporarily in a desired orientation. Depending of the orientation of the tubular structural member in the device or structure, the stiffness of the device or structure will be affected.

The tubular structural member of the present invention, when inserted into the sports equipment, has little tendency to deflect back to a position of lesser resistance when flexed. Accordingly, in most embodiments there is no need to create special anchoring points within the cavity when the tubular structural members are placed in the sports equipment, but these anchor points can be used if desired. Since the tubular structural member is torsionaly stiff relative to its longitudinal stiffness it is torsionaly stable enough to resist movement when flexed if anchored at only one point. The tubular structural member may be fixed in a particular orientation at the time of manufacture or later, allowing the flexural resistance of the device to be decided without changing the type or quantity of materials used.

DETAILED DESCRIPTION OF THE INVENTION

Figure 1:
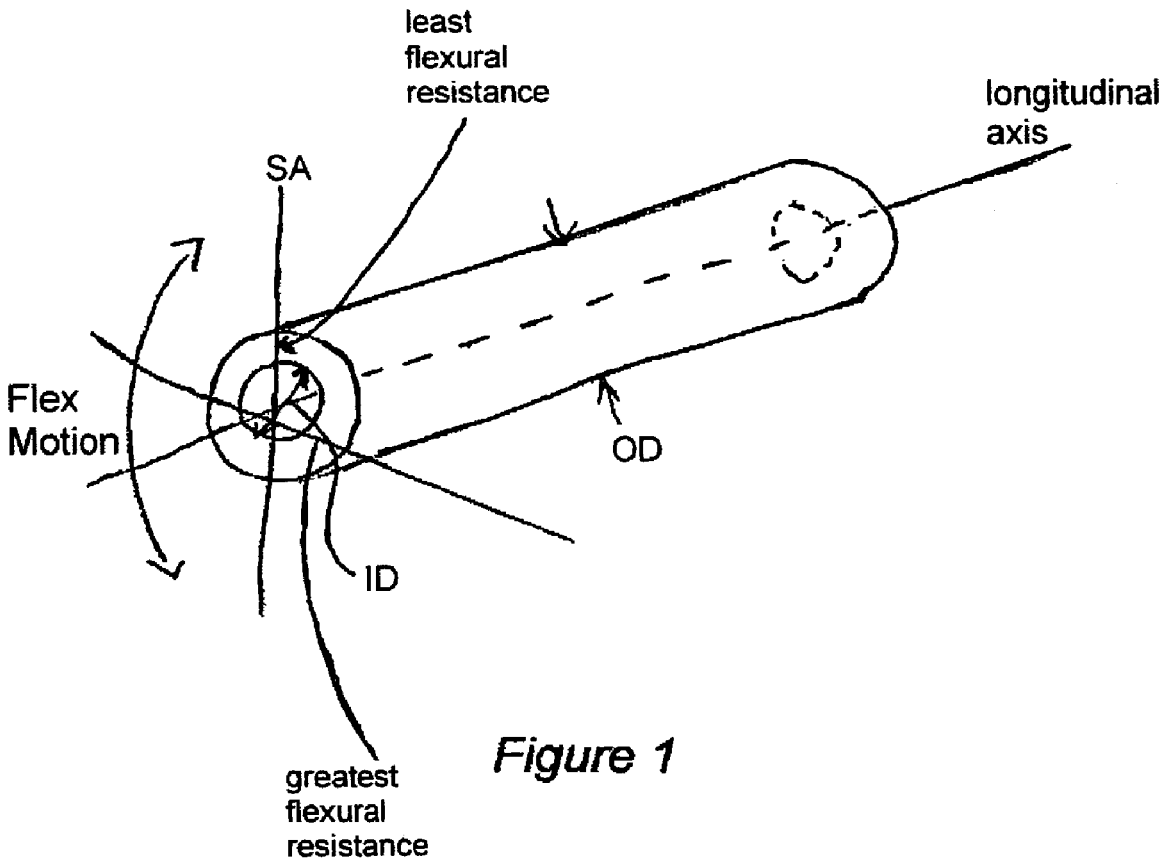
FIG. 1 depicts the axes of the tubular structural member.

The tubular structural member is an improved stiffening insert from U.S. Pat. Nos. 6,113,508 and 6,257,997 B1. However, the tubular structural member functions in a similar manner. The tubular structural member of the present invention are lighter, better at dampening vibration, easier to manufacture and allow for greater variation of flexure. The tubular structural member of the present invention, when inserted into a device or structure, has little tendency to deflect back to a position of lesser resistance when flexed. The tubular structural member may be fixed in a particular orientation at the time of manufacture or later, during use, allowing the flexural resistance of the device to be decided without changing the type or quantity of materials used.

The present invention relates to a tubular structural member that has a flexural resistance greater in one direction than in another. The tubular structural member may be shaped or constructed of materials in order to achieve this effect. The present invention also includes embodiments where the tubular member is tapered along its length.

The present invention can be applied to many types structures and devices where flexure stiffness in one or more directions is important to the use of the device or structure. In particular, sports equipment can benefit from the directional stiffness provided by the present invention. One embodiment employs the tubular structural member in sports equipment having a shaft where flexure along the length of the shaft is important. Sports equipment of this type can include golf clubs, hockey sticks, field hockey sticks, lacrosse sticks, bats, oars, masts, fishing rods, pole vaulting poles, and polo mallets. Another embodiment can be employed where the tubular structural member is in the body of the sports equipment itself. The body can range from a ski or snowboard to the sole of a shoe, sneaker or swimming fin. Other embodiments can employ the tubular structural member in weightlifting equipment. For example, the tubular member can be employed in a resilient panel that provides weight-like resistance to the user. In certain embodiments, the tubular structural member will be inserted into a cavity in the device or structure that has as inner diameter that substantially matches the outer diameter of the tubular structural member. Other embodiments can have a cavity that matches the tapered tubular member's "slope" along the length of the tubular structural member. Another embodiment can be employed where the tubular member is located partially or wholly outside, and affixed to, the body of the device or structure. These embodiments can include sports equipment such as a ski or snowboard, a shoe sole, a resilient panel used in weightlifting equipment, and a swim fin.

The present invention also includes the methods for manufacturing the tubular member and the tapered tubular structural member. In embodiments where the tubular member is to be manufactured for use in sports equipment arranged in a permanent orientation, the method of manufacture results in the ability to produce sports equipment with different flexural properties while using the same raw materials. Methods for creating the present invention can also allow for last minute production and design changes. Allowing for different orders and changes by the customer. In embodiments where the tubular structural member is to have flexural resistance greater in one dimension than in another, the tubular structural member can be produced by a certain method so as to maintain dimensional cohesiveness with the cavity, ensuring a proper fit between the two. Other embodiments can allow for stiffness change variation along the appropriate dimension of the sports device by varying the length and spacing of cut-out machined areas on the tubular member. Other embodiments can employ a similar method where the flexural variations occur along more than one axis. Other methods of construction or manufacture can employ arranging multiple tubular structural members in an arrangement so as to allow the sports equipment to have adjustable flexural resistance in more than one dimension, for example, structures and devices that do not operate in a directional flexural manner. Certain embodiments of the permanently orientated tubular structural member can nonetheless be reorientated and then reset.

Figure 24:
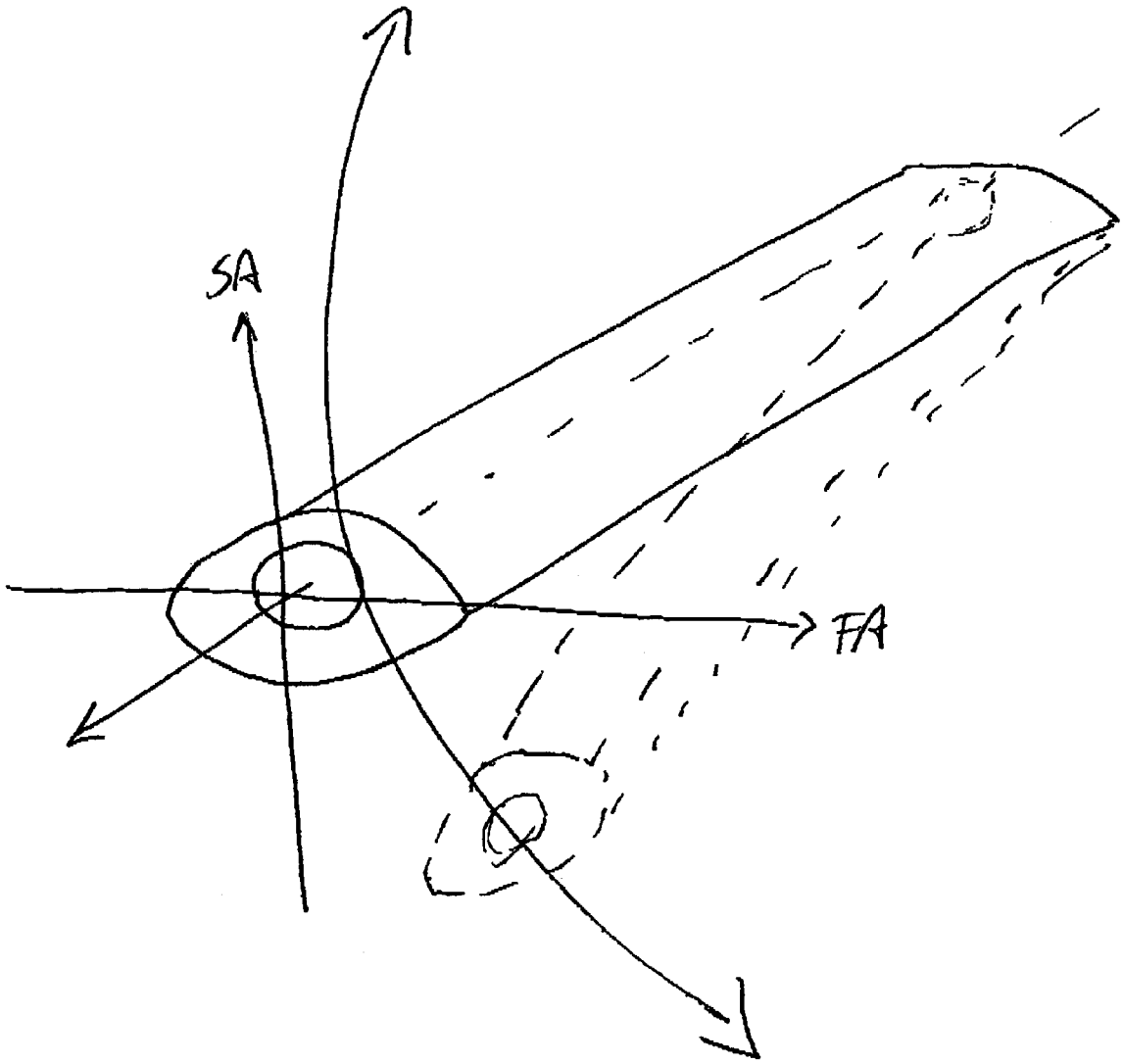
FIG. 24 depicts the axes of motion of a tubular structural member.

The tubular structural members employ directional stiffness. As illustrated in FIG. 24, a tubular structural member has a flexural motion (FM). FIG. 24 also shows the tubular structural member having a stiff axis (SA) and a flexural axis (FA). The flexural motion is the direction the tubular structural member will tend to bend because flexural resistance is least in that portion of the cross section for the tubular structural member to bend. The tubular structural member will be least likely to bend or flex in the direction of the cross section that has the greatest flexural resistance. The direction of flexural motion is about the flexural axis. As shown in FIG. 1, the flexural axis coincides with the portion of the tubular structural member that has the least flexural resistance. Accordingly, the stiff axis is located at the area of greatest flexural resistance. Nonetheless, despite being called the stiff axis, the tubular structural member can still flex across the stiff axis. The tubular structural member will preferably flex about the flexural axis because that is the direction in which resistance to bending is least. In addition, the relationship between the SA and FA are not necessarily perpendicular.

Figure 23:
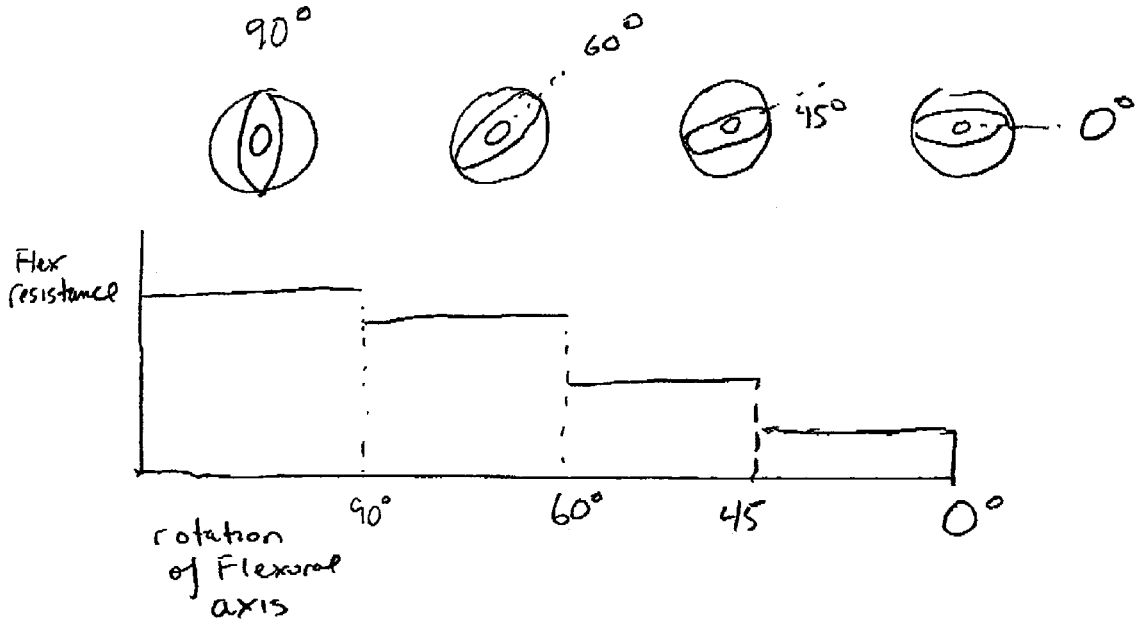
FIG. 23 depicts the effect of rotating the tubular structural member inside a device.

By changing the radial orientation of the tubular structural member, as shown in FIG. 23, the tubular structural member provides a different amount of flexural resistance. Accordingly, depending on the radial orientation of the tubular structural member relative to a force to be resisted, the tubular structural member will resist more or less. When the tubular structural member is inserted into a cavity, therefore, the radial orientation of the stiff axis or flexural axis to the device or structure will affect the stiffness of the device or structure.

The resistance of the tubular structural member can be expressed by the formula:

$$R=E*I$$

Where E is the modulus of elasticity for the tubular structural member and I represents the cross section moment of inertia. Both values may be calculated based on the resilient panel's geometry and composition. The I for a tube is relatively simple to obtain. Similarly, the resistance may be determined by simply measuring the tubular structural member's resistance. By changing either, or both, the modulus of elasticity or the cross section moment of inertia, the resistance of the tubular structural member can be changed. Different embodiments of the tubular structural member can allow for either the modulus or the moment of inertia to be changed, so as to vary the resistance available to the user. For example, embodiments employing a machined tubular structural member are changing the cross section moment of inertia. Embodiments employing different materials are adjusting the modulus of elasticity.

One embodiment of the tubular structural member comprises a tube as shown in FIG. 1. FIG. 1 shows a tube having a longitudinal axis that runs lengthwise along the tubular structural member. The tubular structural member has a flexural resistance that is greatest in one direction than in another. Because flexural resistance is greatest in one direction than in another, the flexural motion of the tubular structural member is greatest in the plane where the flexural resistance is least. The flexural motion is shown in FIG. 1 relative to the flexural axis.

Figure 2:
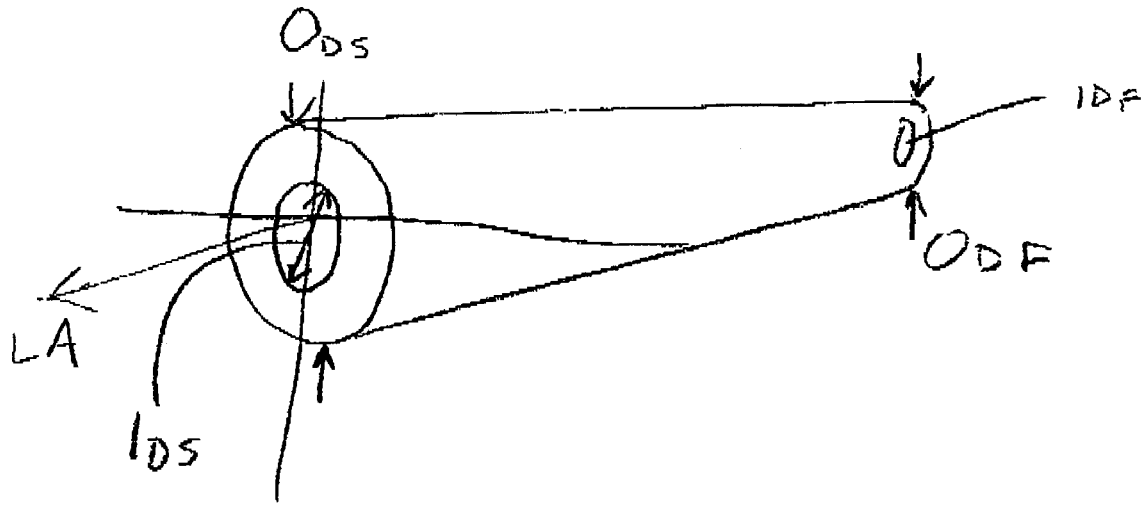
FIG. 2 depicts a tapered tubular structural member.

In another embodiment of the present invention the tubular structural member is tapered. FIG. 2 depicts the tapered tubular structural member. As depicted in FIG. 2, the tapered tubular structural member has a taper that result in an initial outer diameter (ODi) and inner diameter (IDi). The tapered tubular structural member likewise also has a final outer diameter (ODf) and inner diameter (IDf).

Figure 3:
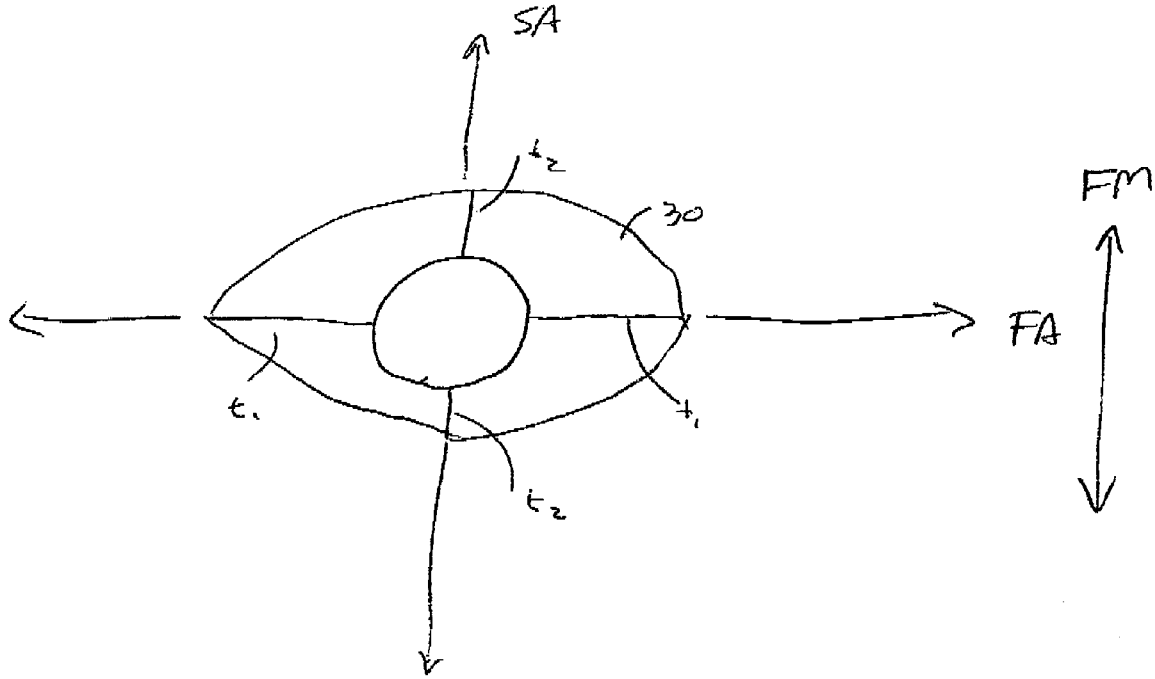
FIG. 3 depicts a varied thickness tubular structural member.

FIG. 3 depicts an embodiment where the tubular structural member 30 has a tube wall thickness t that varies so that the wall thickness is greatest at point t1, which coincides with the flexural axis. The varied tubular structural member 30 has the FA at point t1. The wall thickness is least at point t2 where the stiff axis is located. The tubular structural member is most likely to bend about the area of least flexural resistance, creating flexural motion about the flexural axis.

Figure 4:
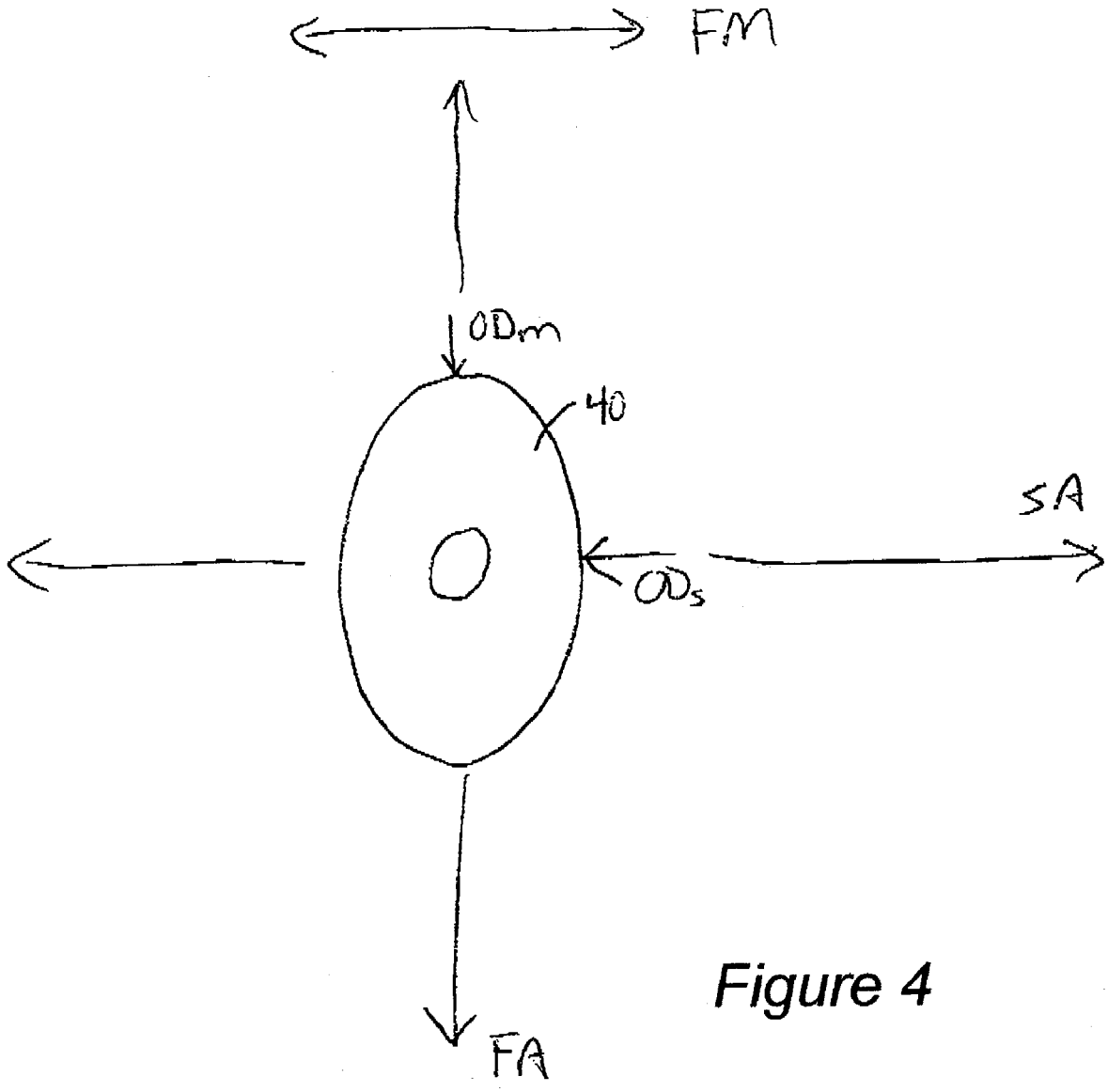
FIG. 4 depicts a varied outer diameter tubular structural member.

FIG. 4 depicts an embodiment where the outer diameter of the tubular structural member varies. The tubular structural member can have an outer shape that is ovoid, elliptical, or any other shape that creates a flexural resistance profile that is greater in one direction than in another. FIG. 4 depicts the larger outer diameter (Odm) that coincides with the flexural axis. The smaller outer diameter (Ods) coincides with the stiff axis. The varied outer diameter tubular structural member 40 accordingly has flexural motion opposite the flexural axis.

Figure 5:
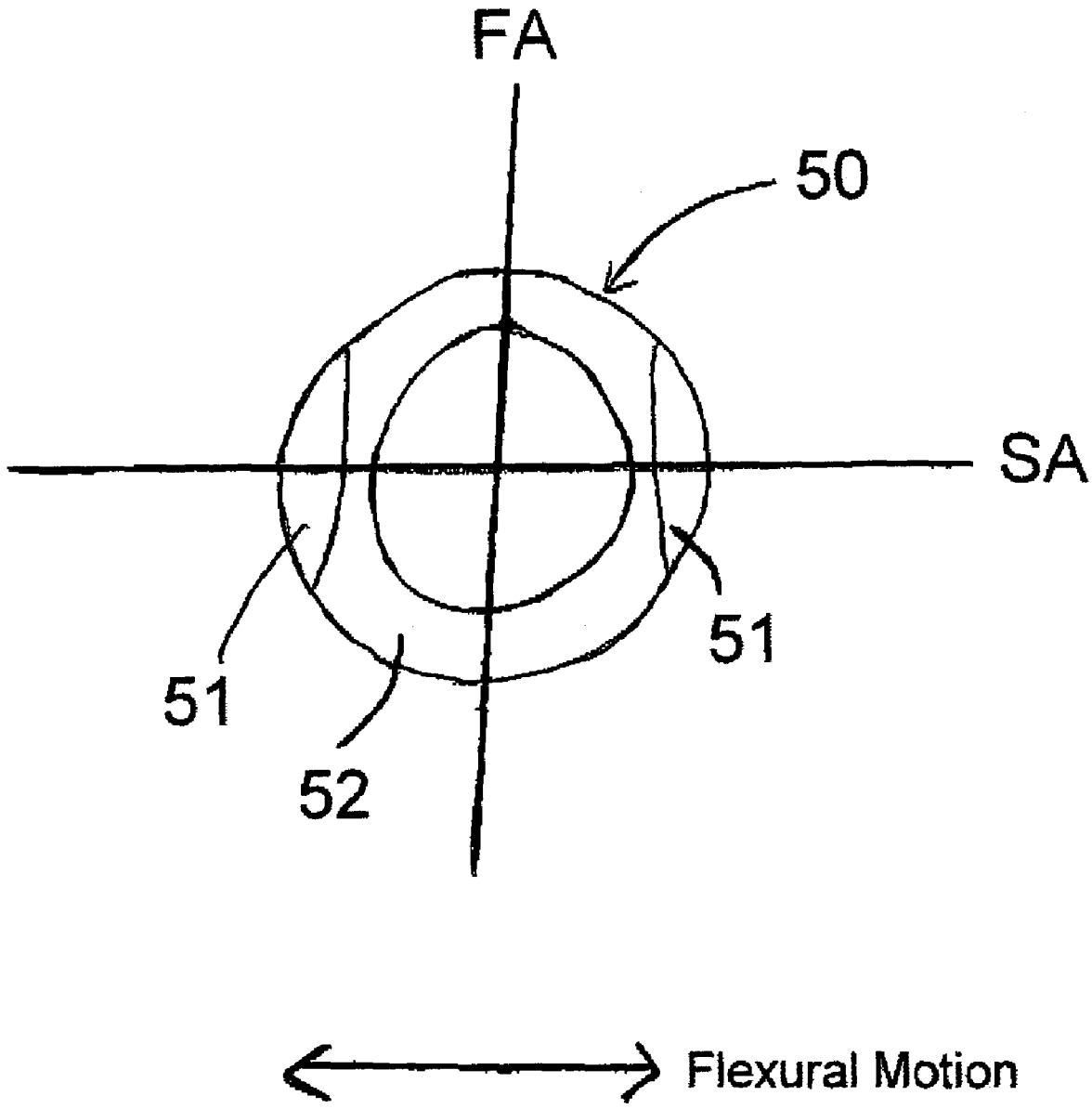
FIG. 5 depicts a dual composite material tubular structural member.

An embodiment of the present invention can have the tubular structural member comprised of several different materials. Each of the materials has a different flexural resistance. The location of the different materials within the tubular structural member varies so as that the composite flexural resistance of the composite tubular structural member is greatest along the flexural axis. FIG. 5 depicts a dual composite material tubular structural member 50 that consists of the arrangement of two materials, a greater flexural resistance material 52, and a lesser flexural resistance material 51. The dual composite material tubular structural member 50 is consists of an arrangement of two materials in the shape of a tube. Other embodiments can consist of arrangements of more than two materials, each having a different flexural resistance. The arrangement of the materials having the greater flexural resistance and the lesser flexural resistance is such that the composite cross section creates a tubular structural member having a flexural resistance greater in one direction than in another. The radial orientation from the longitudinal axis of the flexural axis coincides with the greatest flexural resistance of the tubular structural member. The flexural motion is about the flexural axis, similar to other embodiments. Likewise, the stiff axis is less likely to flex.

Figure 6:
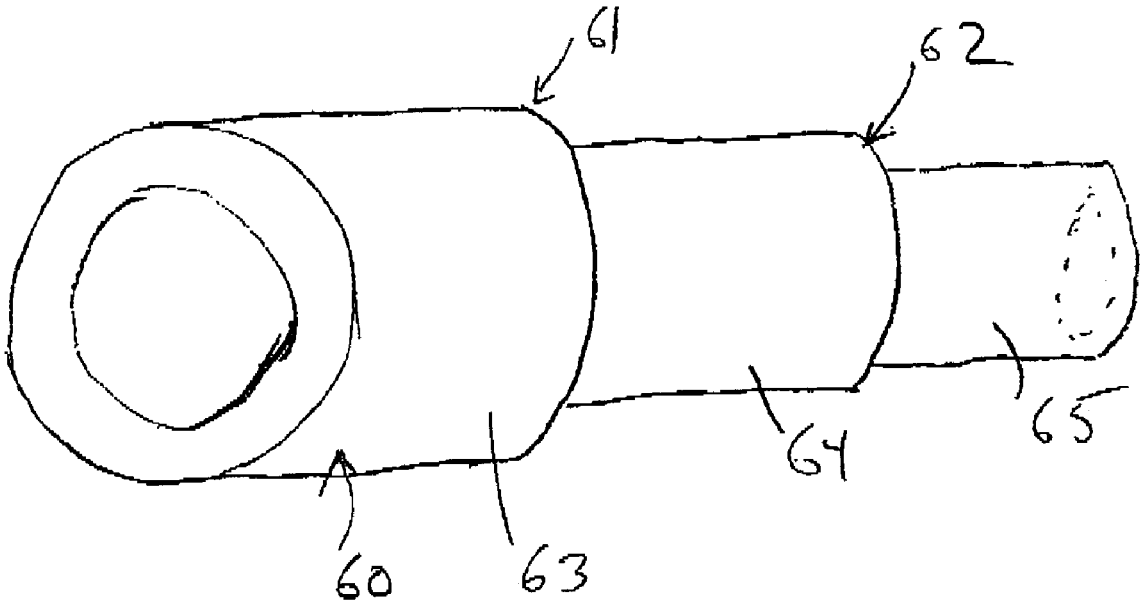
FIG. 6 depicts a step down tubular structural member.

Other embodiments of the tubular structural member can employ step down points along the longitudinal axis. The outer diameter of the tubular structural member decreases at each step down. FIG. 6 depicts a step down tubular structural member 60, where step downs 61 and 62 mark the drop in outer diameter of sections 63, 64, and 65. Embodiments that possess the step down structure will nonetheless have a flexural resistance that is greater in one direction than in another, along each section. However, embodiments can have sections that are not directionally stiff tubular structural members.

Figure 7:
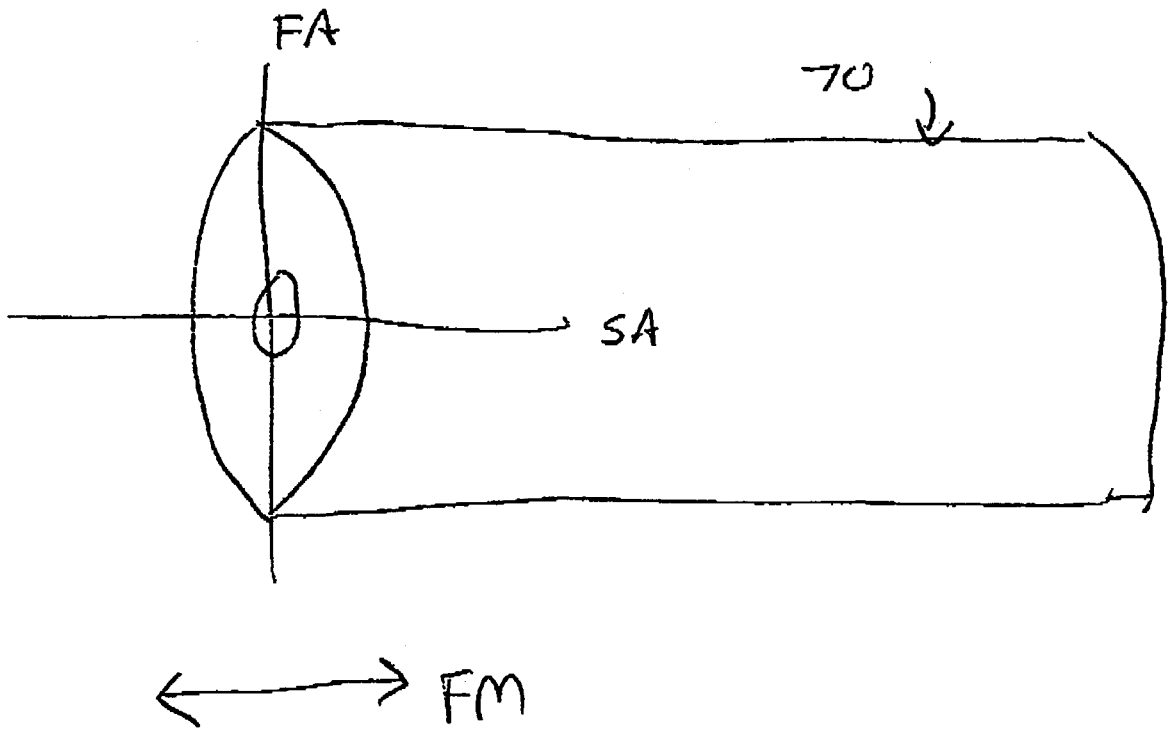
FIG. 7 depicts a tubular structural member shaped as an elongated spine.
Figure 8:
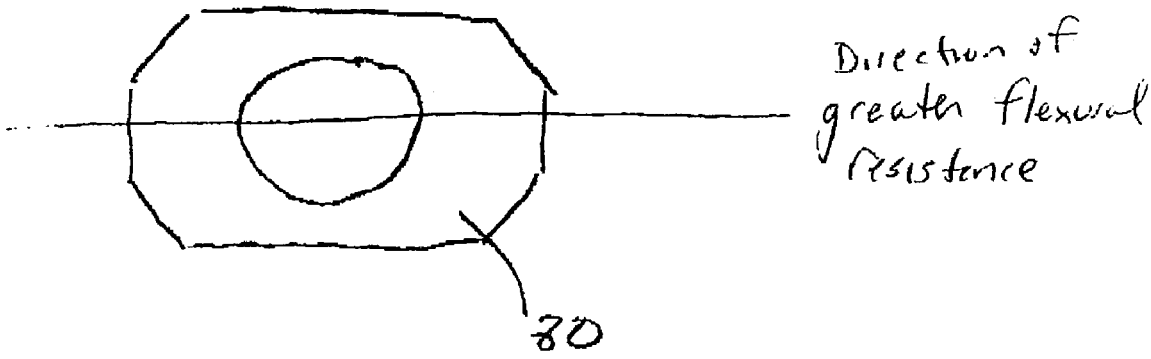
FIG. 8 depicts a polygonal tubular structural member.

Certain embodiments of the tubular structural member can have an outer body shape of varying shapes. FIG. 7 depicts a elongated tubular structural member 70 that has a greater flexural stiffness in one direction than in another. In this embodiment, the greater flexural stiffness is along the longer side of the spine, coinciding with the flexural axis. The stiff axis coincides with the thinner portion of the elongation. Flexural motion is about the flexural axis. FIG. 8 depicts another embodiment, a polygonal tubular structural member 80 which has eight sides. A tubular structural member shaped as a polygon can have any number of sides. The sides of the polygonal tubular structural member are arranged and spaced so as to provide the polygonal tubular structural member 80 with flexural resistance that is greater in one direction than in another.

Figure 9:
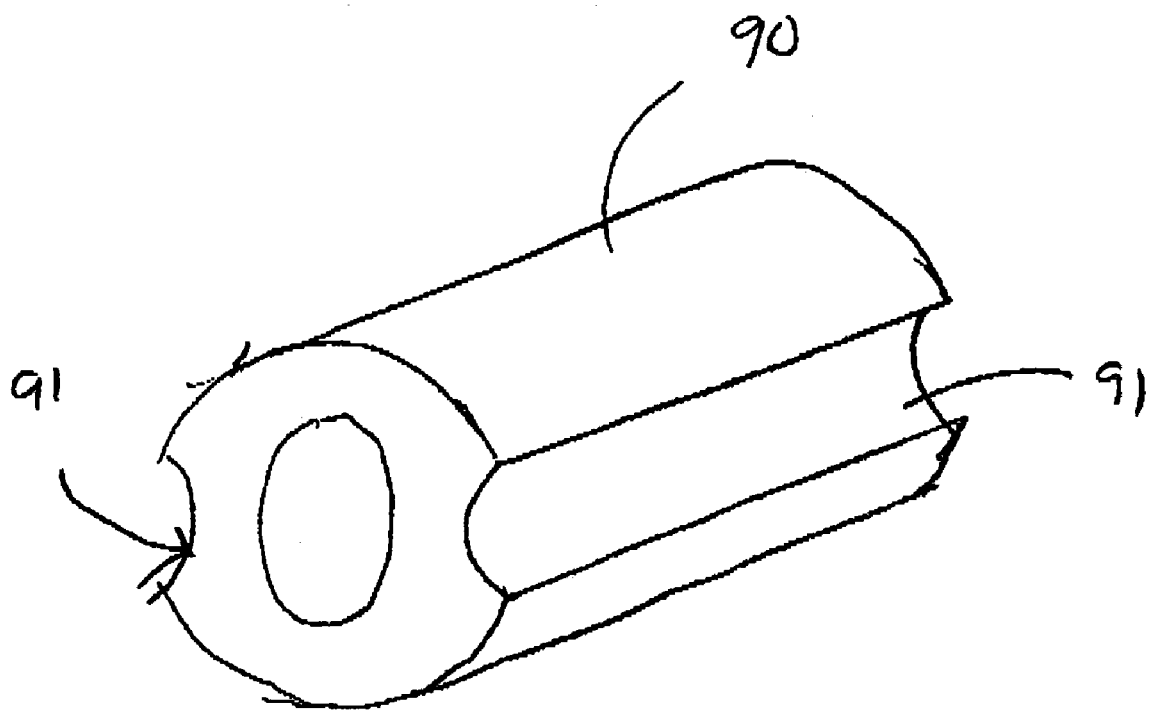
FIG. 9 depicts a longitudinally grooved tubular structural member.
Figure 10A:
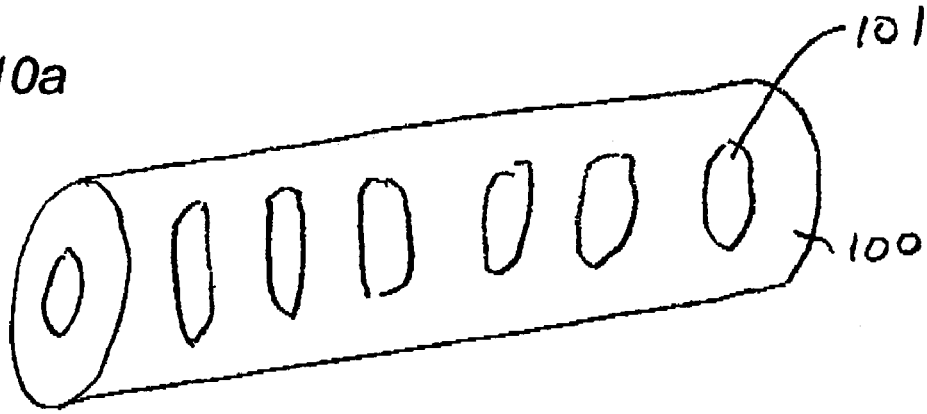
FIGS. 10*a* and 10*b* depict a laterally grooved tubular structural member.
Figure 10B:
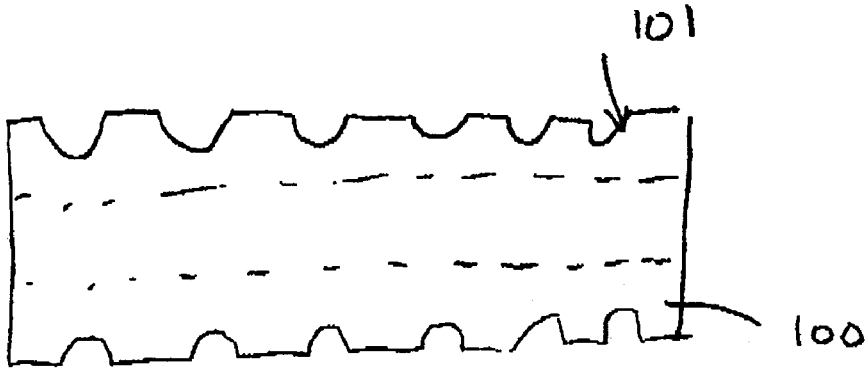
Figure 25:
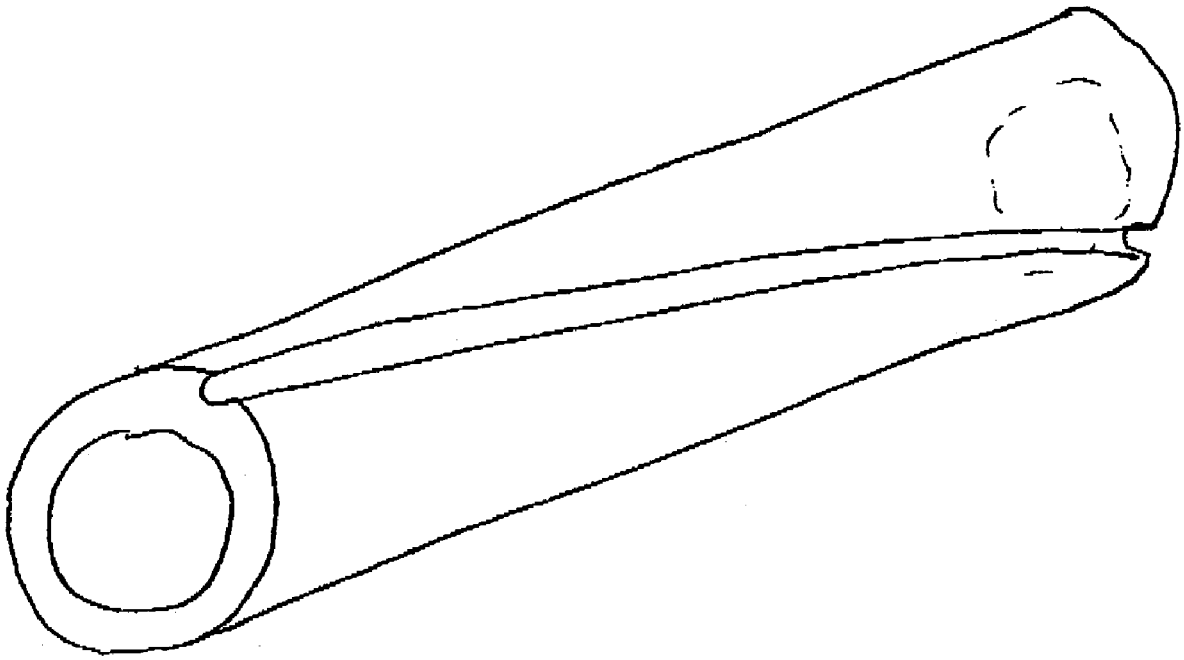
FIG. 25 depicts a tubular structural member having a diagonal groove.
Figure 26A:
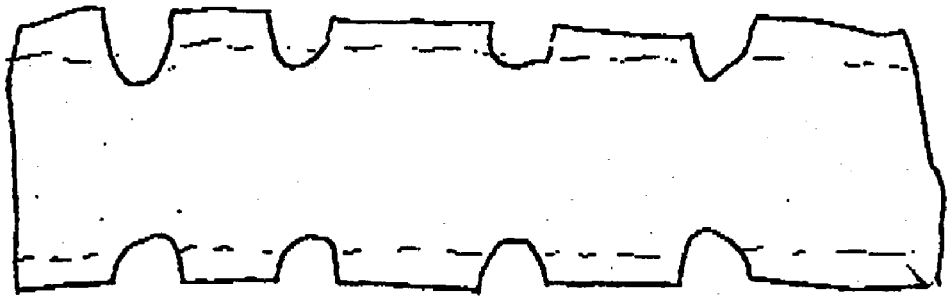
FIGS. 26*a* and 26*b* depict a tubular structural member having lateral slots.
Figure 26B:
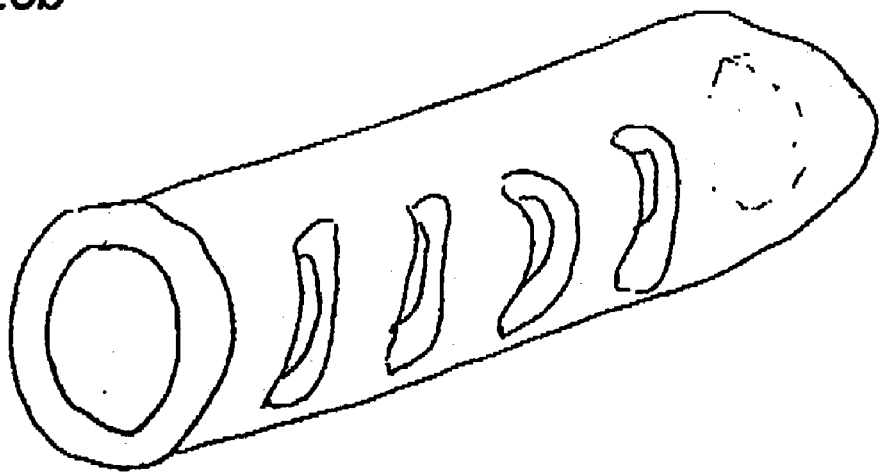

In other embodiments, the tubular structural member can be grooved. FIG. 9 depicts a longitudinally grooved tubular structural member 90 that has two grooves running along the tube. Any number of embodiments can exist depending on the location, depth and length of the longitudinal grooves on the tubular structural member. The grooves are located so as to provide the tubular structural member with a flexural resistance that is greater in one direction than in another. By removing material from the tubular structural member, the cross sectional moment of inertia is changed FIG. 9 depicts a tubular structural member 90 having two grooves 91 located so as to create a flexural axis by removing material from the outer wall of the tubular structural member. FIG. 10 depicts a laterally grooved tubular structural member. The grooves are located so as to provide the tubular structural member with a flexural resistance that is greater in one direction. FIG. 25 depicts a tubular structural member with diagonal grooves. Other embodiments can have slots that go through the tubular structural member walls. FIGS. 26*a* and 26*b* depict a tubular structural member having slots running in the lateral direction.

In certain embodiments, the tubular structural member can be filled with foam. In embodiments employing a rigid foam, a polyurethane foam can be employed. Other embodiments can employ a non-structural foam. This foam can be used to dampen vibrations.

Figure 20:
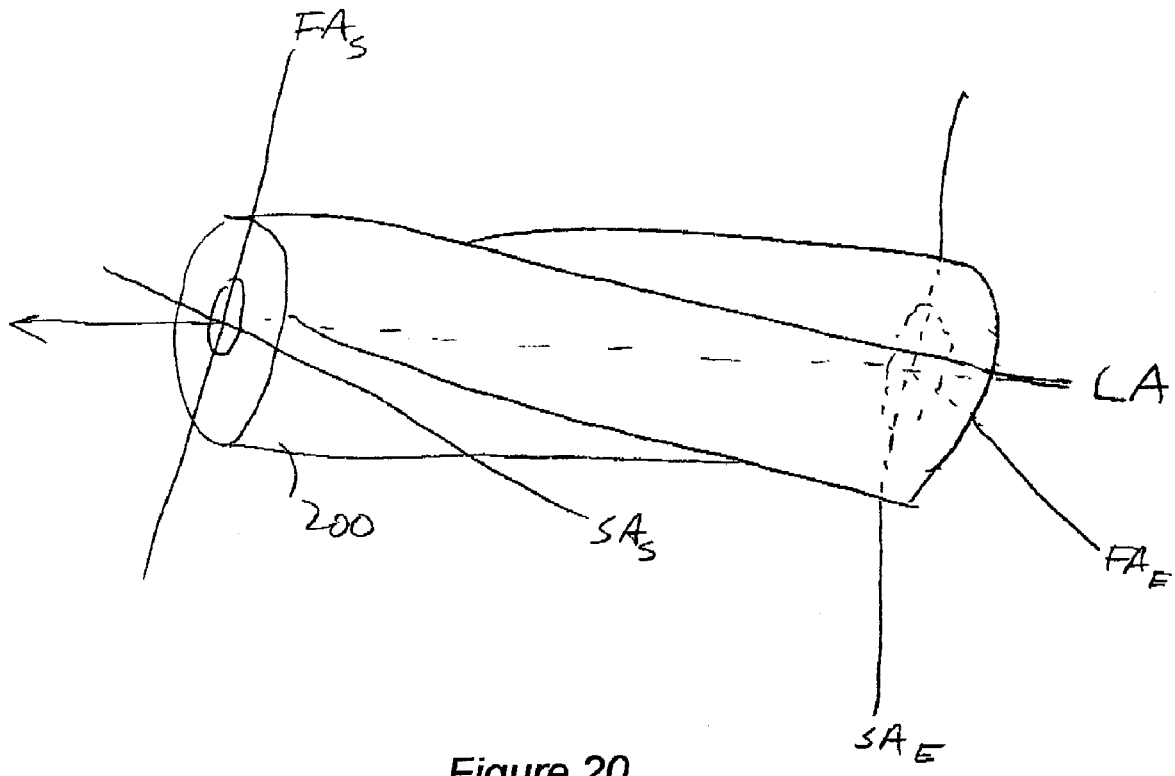
FIG. 20 depicts a tubular structural member with a spiral spine structure.
Figure 21:
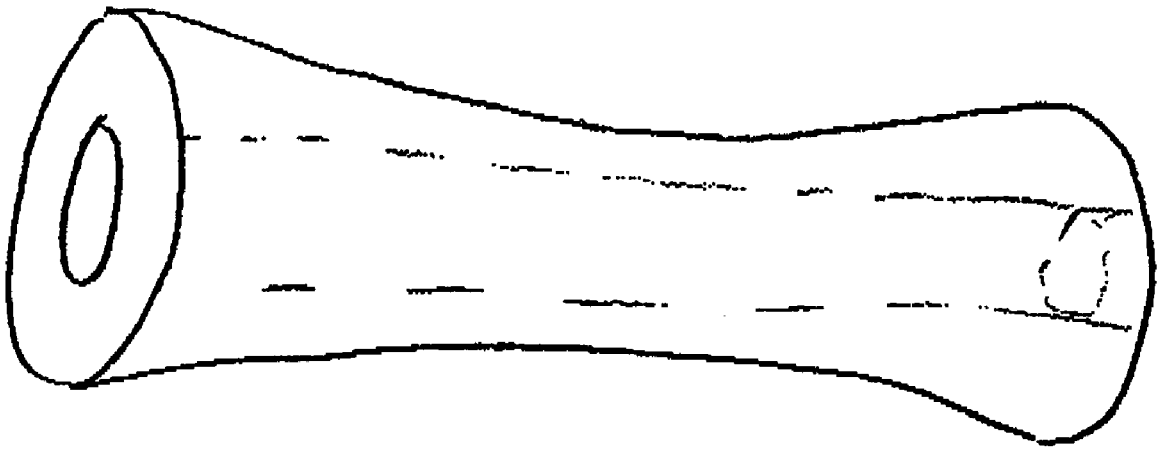
FIG. 21 depicts a tubular structural member having varied flexural resistance along its longitudinal axis.

Certain embodiments of the tubular structural member can provide varied flexural resistance in more than one plane. Other embodiments can vary the flexural resistance along the longitudinal axis. Another embodiment can vary the flexural resistance both along the longitudinal axis and with radially with respect to the longitudinal axis. FIG. 20 depicts a spiral tubular structural member 200. The radial orientation of the flexural axis with respect to the longitudinal axis varies by 90 degrees from start to finish of the tube. Accordingly, along the length of the tube, the direction of the flexural resistance changes. Thus, the SA and FA rotational configuration change along the longitudinal axis. FIG. 21 depicts a tubular structural member 210 that has increased flexural resistance at its ends, with lesser flexural resistance at its center.

The various embodiments of the tubular structural member can be employed in various devices in order to reinforce or change the flexural resistance or stiffness of the device. These devices can typically be sporting devices where it is desirable to set or be able to change the stiffness or the flexural resistance.

Figure 32:
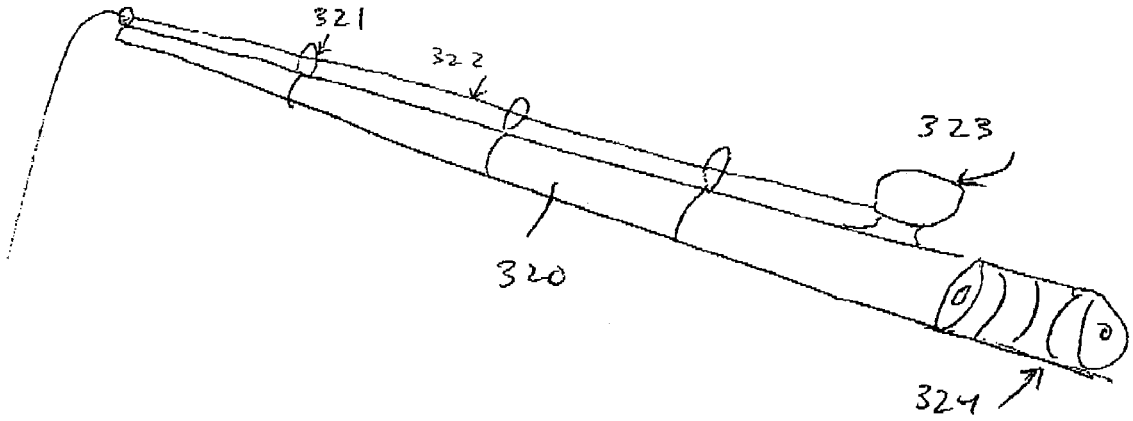
FIG. 32 depicts a fishing rod constructed from a tubular structural member.

The tubular structural member can be employed alone in one embodiment as a fishing rod. As shown in FIG. 32, tubular structural member 320 forms a fishing rod. The fishing rod 320 has a line guides 321, line 322, and a reel 323. A handle area 324 can be place on the end of the rod 320. In other embodiments, the handle can be part of the tubular structural member itself. Depending on the desired fishing rod stiffness, the line guides 321 and reel 323 can be aligned with either the stiff axis or the flexural axis, or any position between. Thus, the fishing rod 320 can present the user with a range of stiffnesses.

Figure 11:
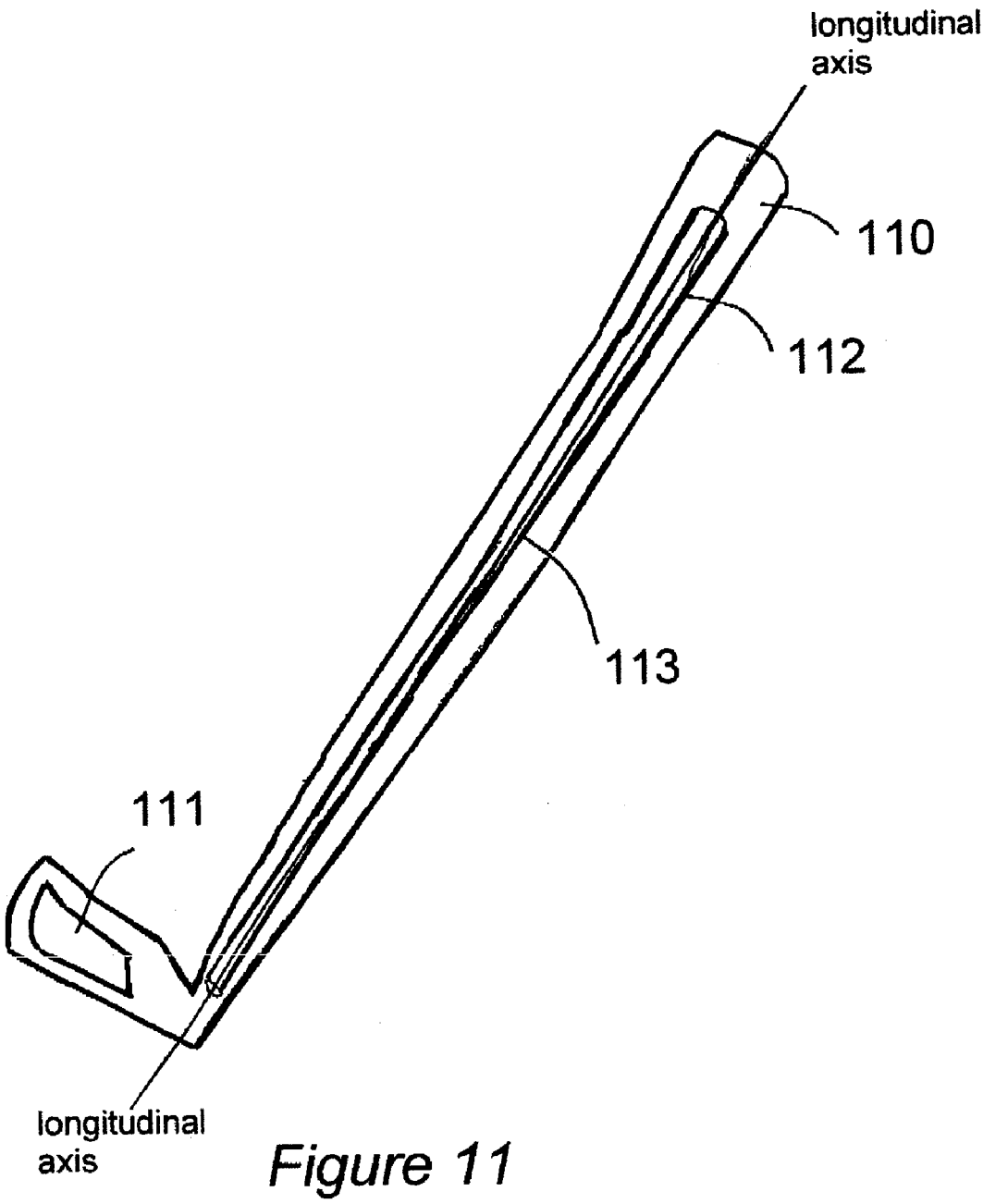
FIG. 11 depicts a golf club employing a tubular structural member.

Embodiments of the present invention can include a sporting device such as a golf club. FIG. 11 depicts a golf club 110 having a head 111 with a longitudinal axis. The golf club also has a cavity 112 located along its longitudinal axis. The cavity 112 is machined so that its inner diameter is equal to the outer diameter of the tubular structural member 113. In an embodiment of a golf club employing a tubular structural member, a tubular structural member 113 is inserted into the cavity 112. The location of the flexural axis of the tubular structural member 113 can be adjusted with respect to the desired flexural motion of the golf club. Depending on the orientation of the flexural axis tubular structural member, the golf club will have a greater or lesser stiffness.

Embodiments of the present invention employing a tubular structural member in a device or structure can also have a directional indicator. The directional indicator can show the user the degree of rotation of the tubular structural member. Other embodiments can also show the total flexural resistance supplied by the tubular structural member to the device or structure resulting from the tubular structural member's radial orientation within the device or structure.

One embodiment can be employed in the shafts of sports equipment where flexural stiffness is important in one dimension. For example, the flexural resistance for golf clubs is important relative to the plane perpendicular to the face of the club head. Accordingly, a tubular structural member can be employed that will adjust the stiffness of the club in that one dimension.

Embodiments of the present invention employing a tubular structural member is a device or structure can also have a cap or other device to hold the tubular structural member in place within the cavity. Certain embodiments can hold the tubular structural member in place. Other embodiments can have a cap that can provide the user with means to rotate the tubular structural member inside the device or structure. Embodiments of the present invention can employ the capping device with a directional indicator to illustrate to the user the amount the tubular structural member has been rotated.

Figure 12:
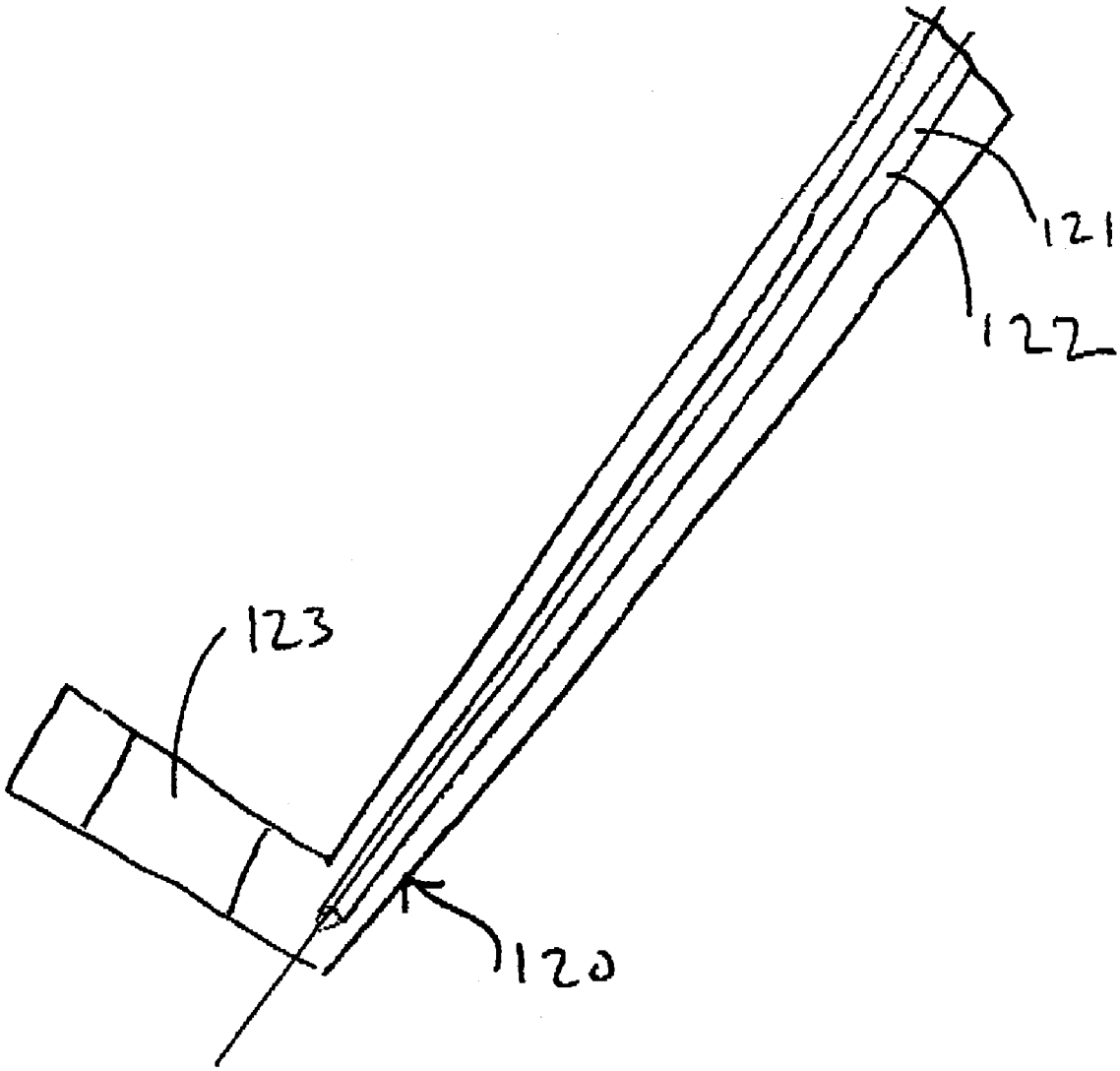
FIG. 12 depicts a hockey stick employing a tubular structural member.

Similarly, the tubular structural member can be employed in hockey sticks to adjust the stiffness of the hockey stick relative to the face of the hockey stick. FIG. 12 depicts a hockey stick 120 having a cavity 121 with an inner diameter that matches the outer diameter of the tubular structural member 122. The flexural motion of the hockey stick 120 is perpendicular to the hockey stick face 123. Depending on the radial alignment of the flexural axis of the tubular structural member with respect to the hockey stick flexural motion, the stiffness of the hockey stick will change.

In different embodiments of the tubular structural member, the tolerances between the outer diameter of the tubular structural member and the inner diameter of the cavity depends on the size, application and the materials used. Where embodiments employing a tapered tubular structural member are used within a cavity, the tolerances between the outer diameter of the tapered tubular structural member and the inner diameter of the cavity can vary because the tolerance will change depending on how far the tubular structural member is inserted into the cavity. Depending on the embodiment, the tolerance will range can be as close as 1/1000 inch. Other embodiments can have tolerances of up to 1/100 inch. The closer the tolerance, the tighter the fit between the tubular structural member and the cavity. Accordingly, the tolerances depend on the use of the structure or device employing the tubular structural member. The tolerances between the tubular structural member and the cavity can also depend where different embodiments provide a coating, lubricant or cushioning between the two. In embodiments where the tubular structure member is machined so as to have a "hairlike" finish, thus having a tighter tolerance than a smoothly-finished tubular structural member. The use of the "hairlike" finish can provide both cushioning and ease of rotation.

Figure 27:
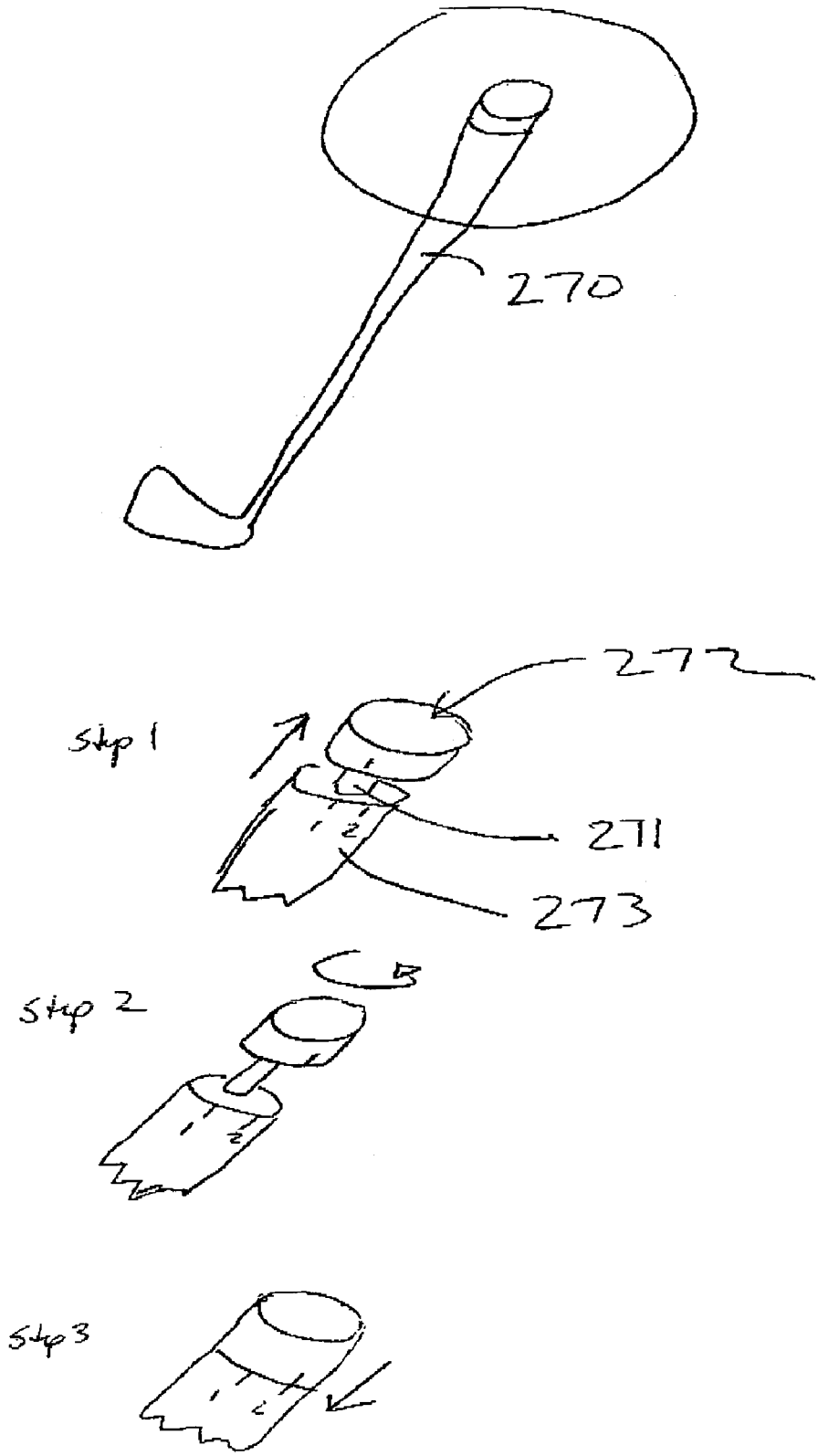
FIG. 27 depicts a means of rotating the tubular structural member inside a golf club and a means of indicating the relative position of the tubular structural member to indicate relative stiffness.
Figure 29:
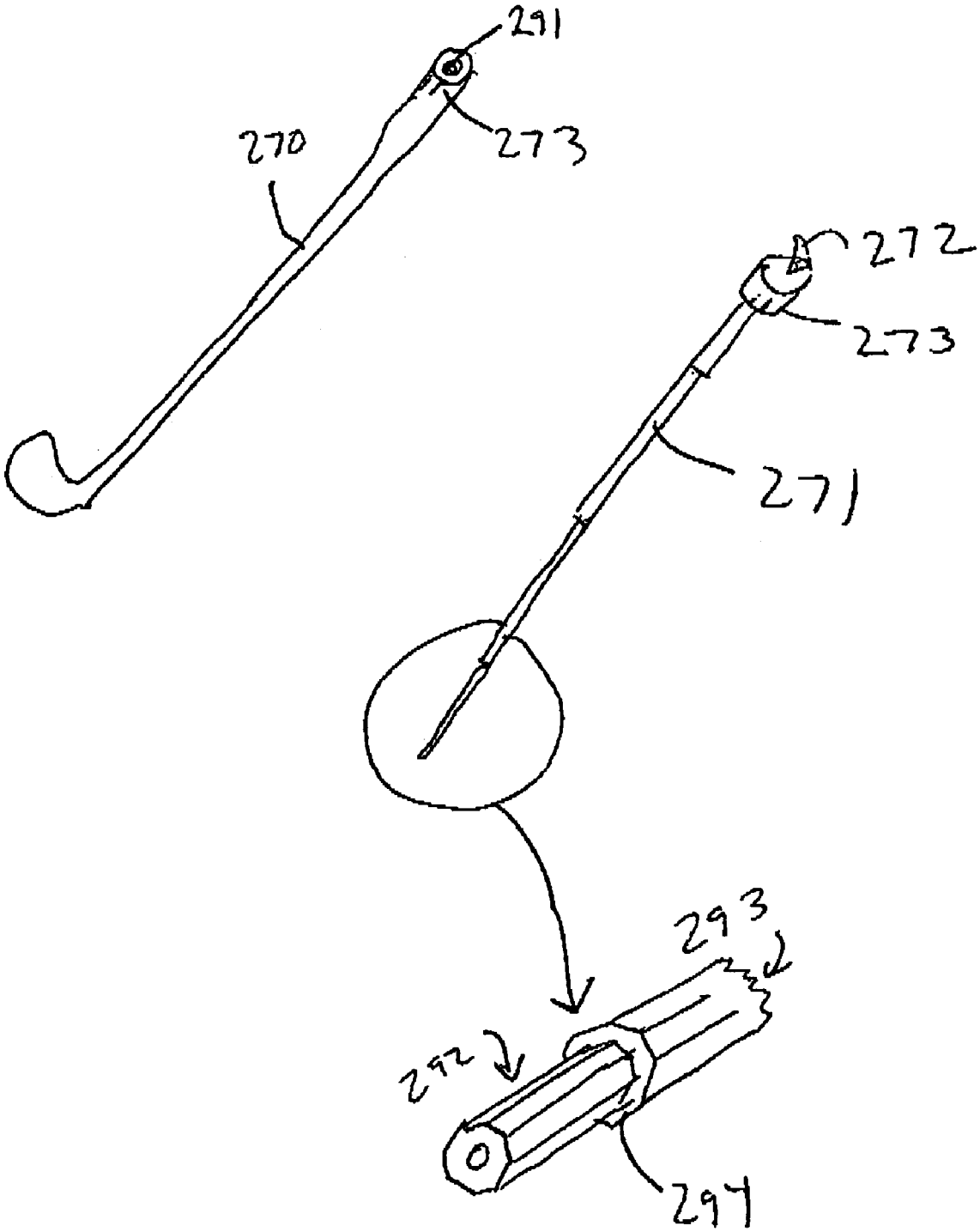
FIG. 29 depicts changing the stiffness of the golf club employing a stepped polygonal tubular structural member.

Embodiments of sporting devices that utilize a tubular structural member can be arranged with any of the above embodiments. One such embodiment is a golf club that employs a tubular structural member that has both step downs and a polygonally shaped tubular structural member. Because of the shape of the shaped tubular structural member, the user can adjust the stiffness of the golf club by rotating the shaped tubular structural member to a new orientation. The shaped tubular structural member fixed in place by the friction caused by the meeting of the tube's outer walls surfaces with the cavity's inner wall surfaces. In other embodiments, the tubular structural member in the golf club can be permanently set. FIG. 27 depicts the steps in changing the stiffness of the golf club 270. Step 1 involves removing the tubular structural member 271 by grasping the holding knob 272. The holding knob 272 has markings 273 that indicate the rotation of the tubular structural member within the golf club. The holding knob is rotated to a new orientation in step 2. In step 3, the tubular structural member is reinserted into the golf club. Because the structure has step downs, the tubular structural member need only be removed a small amount to disengage the outer walls of the tubular structural member from the inner walls of the cavity. FIG. 29 illustrates the parts that make up the stepped polygonal golf club, including the golf club 270, the knob 272, the stepped polygonal tubular structural member 271 and the cavity 291. Also illustrated are the lowest two sections 292 and 293 with step down 294.

Another embodiment of the present invention can employ the tubular structural member in other devices. For example, skis and snowboards can have the tubular structural member inserted into or on the body to change the stiffness of the board or ski itself. The user can adjust the stiffness. Or, in certain business method embodiments, a renter can adjust the stiffness of a rental ski unit to correspond to the renter's physique, strength, or level of skill. In other embodiments, other types of sports equipment can have a tubular structural member system installed in the body area, including shoes or sneakers, bats, mallets, masts, pole vaults.

Figure 13A:
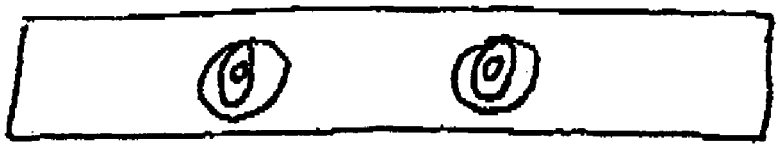
FIGS. 13*a*, 13*b* and 13*c* depict cross sections of a ski or snowboard employing a tubular structural member.
Figure 13B:
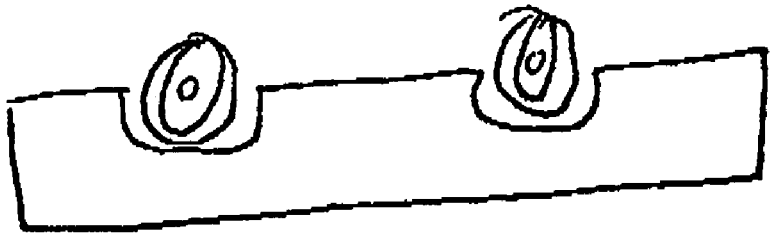
Figure 13C:
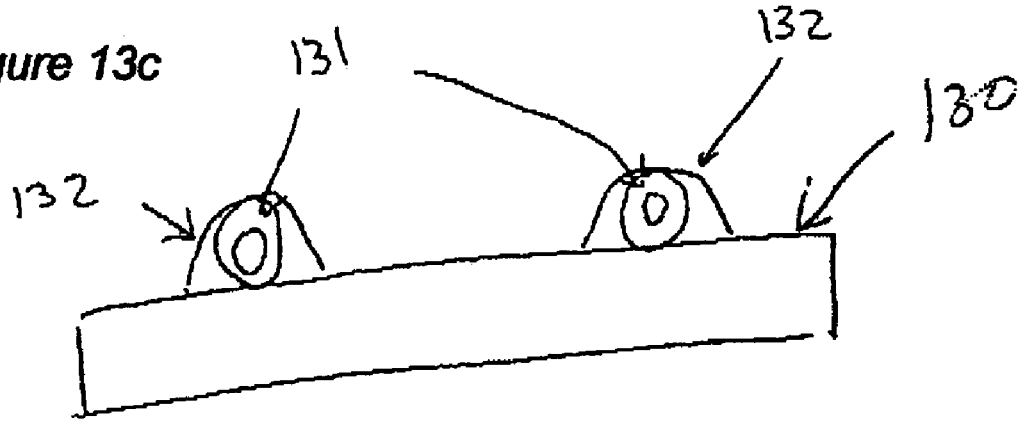
Figure 14:
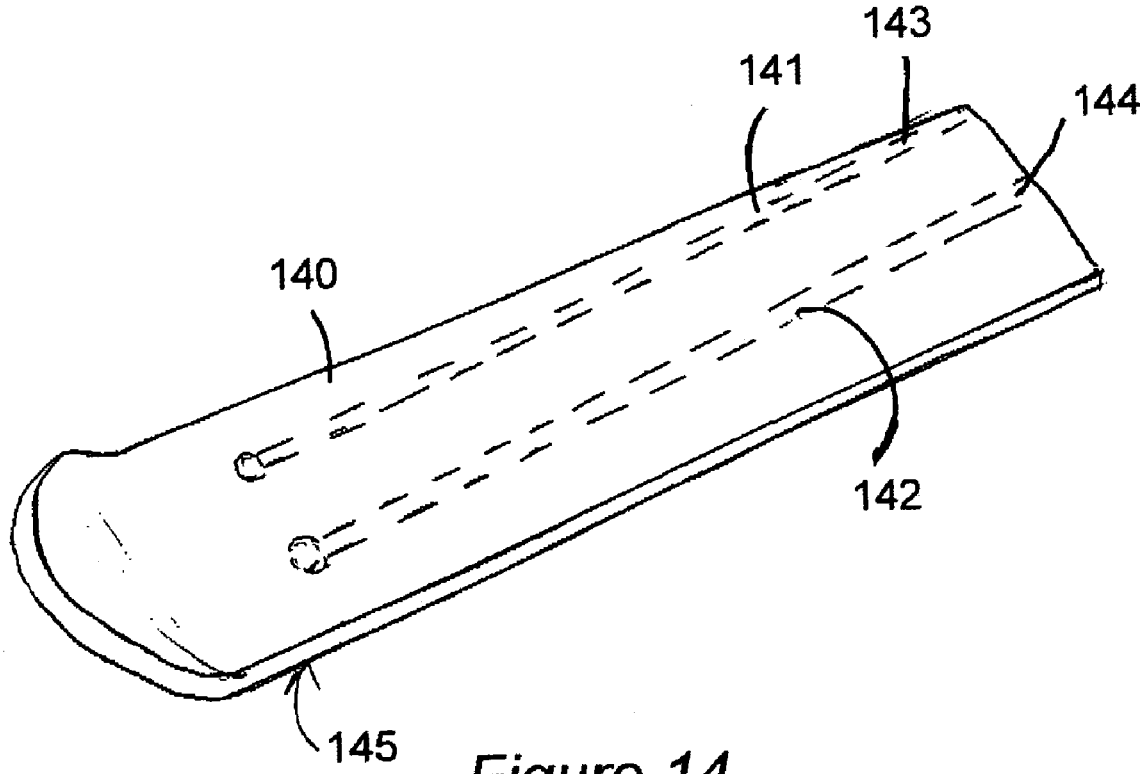
FIG. 14 depicts a snowboard or ski employing two parallel tubular structural members.

FIG. 14 depicts a ski or a snowboard 140 utilizing two tubular structural members 141, 142 inserted respectively into cavities 143, 144. Skis and snowboards typically have a flexural motion along the bottom face of the ski or snowboard 145. FIGS. 13*a*–13*c* depict a cross section of the tubular structural members used with a snowboard or ski body. FIG. 13*a* depicts a cross section of a ski or snowboard having two tubular structural members within the ski or snowboard body itself. FIG. 13*b* depicts the cross section of two tubular structural members, each within a respective recess on top of the body. FIG. 13*c* depicts a ski or snowboard where two tubular structural members are located on a top of the body. Ski or snowboard body 130 has two tubular structural members 131 held in place, each by a holding device or guide 132.

Figure 15:
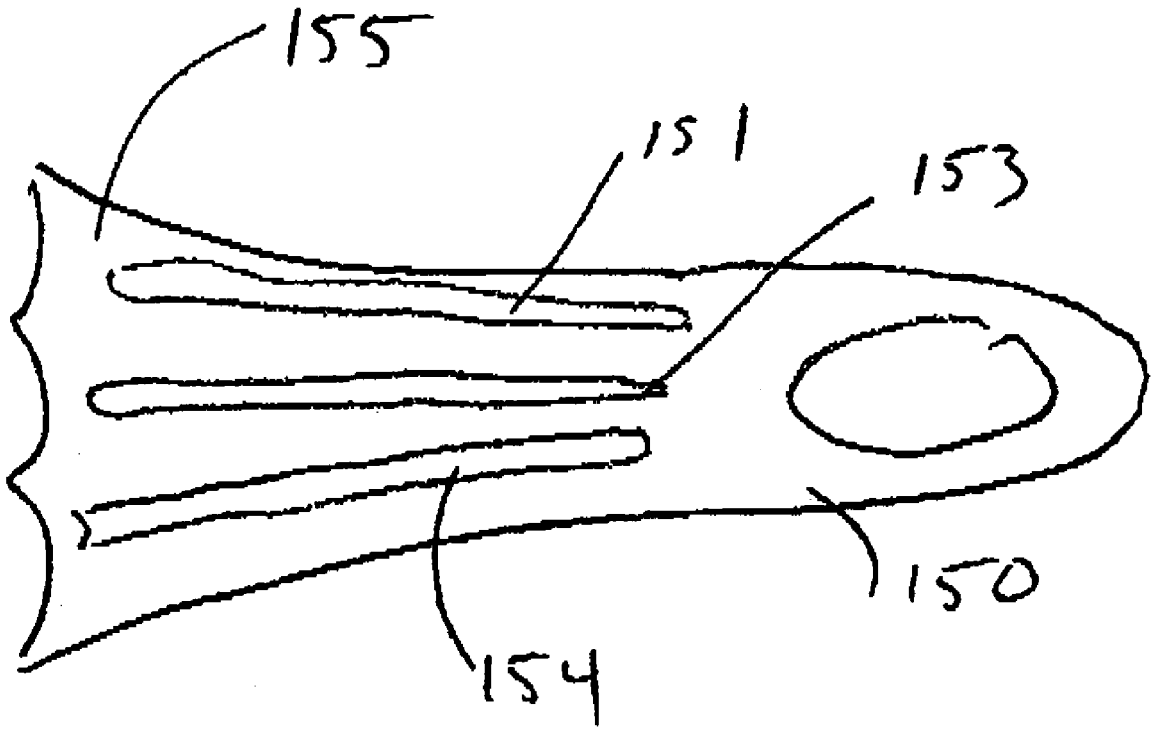
FIG. 15 depicts a swim fin employing three tubular structural members.

FIG. 15 depicts a swimming fin 150 employing three tubular structural members 151, 153, 154 which are located in the web area of the fin 155. In this embodiment, the tubular structural members are held in place within the webbing itself.

Figure 16:
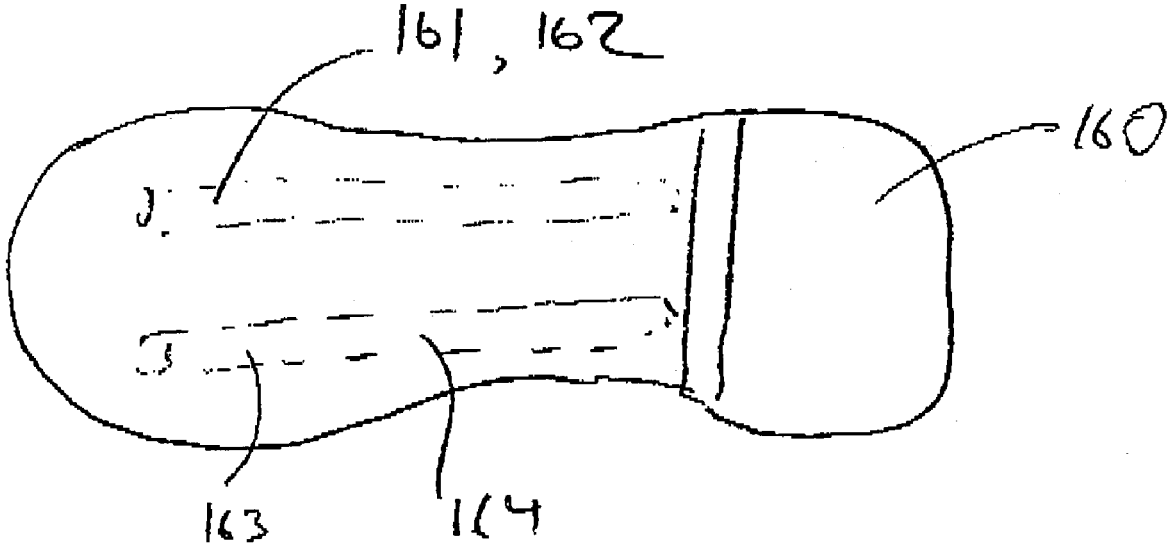
FIG. 16 depicts a shoe employing two tubular structural members.

FIG. 16 depicts a sole of a shoe 160 having two tubular structural members 161, 163 inserted respectively into two cavities 162, 164. The desired shoe stiffness can be achieved by either the manufacturer or user, depending on the embodiment, by rotating the tubular structural member relative to the sole of the shoe. The manufacturer can set the tubular structural member's orientation at the time of manufacturing. The shoe can also be manufactured to allow the user to manually turn the tubular structural member.

In applications where the flexural stiffness needs to be adjusted in more than one direction, some embodiments can have an arrangement of tubular structural member that ensures that stiffness is adjusted uniformly across all appropriate dimensions. For example, certain cylindrical sports equipment, such as pole vault poles, sailing masts, baseball bats and oars, are typically employed omnidirectionally. The device is meant to flex in any direction, because there is no face. An arrangement of tubular structural members can be employed so as to adjust stiffness to the device, while ensuring that the stiffness in not only adjusted in one dimension.

Figure 17:
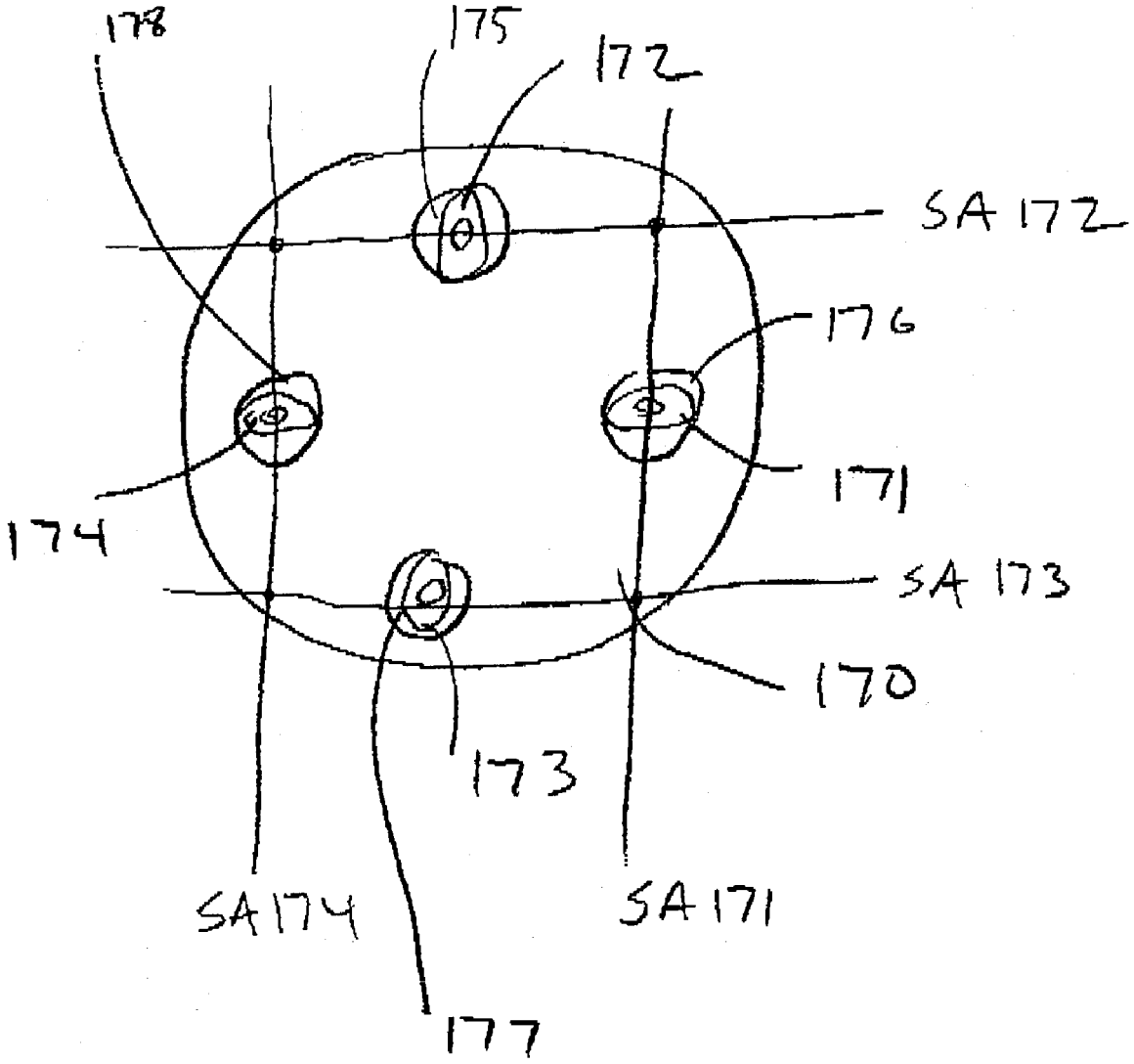
FIG. 17 depicts a mast employing multiple tubular structural members.
Figure 18:
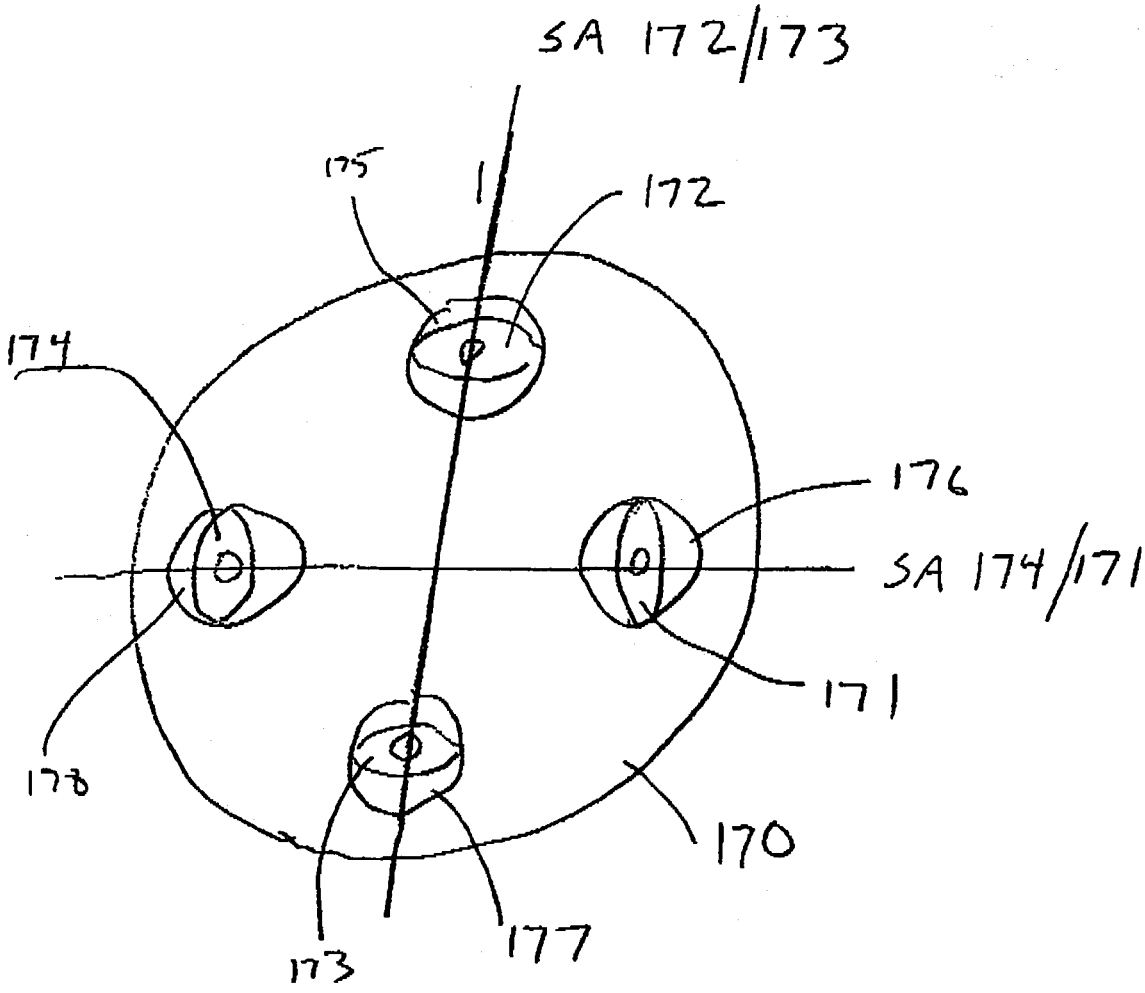
FIG. 18 depicts a mast employing multiple tubular structural members.
Figures 30A, 30B:
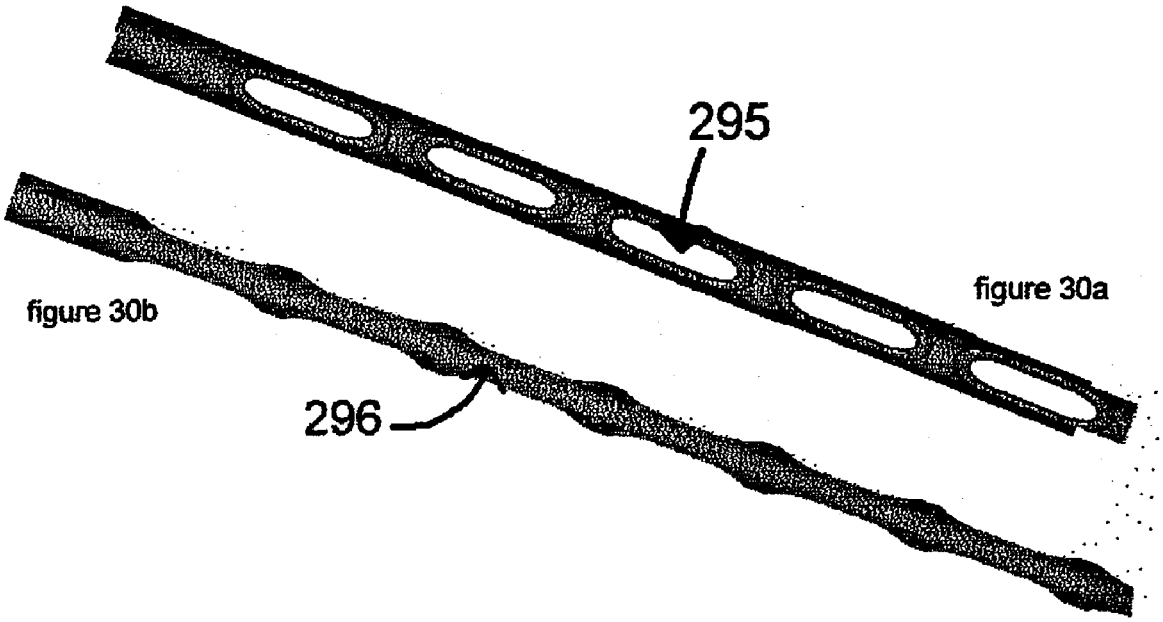
FIGS. 30*a* and 30*b* depicts a tubular structural member with material removed in ovoid configurations along its longitudinal axis.
Figure 31:
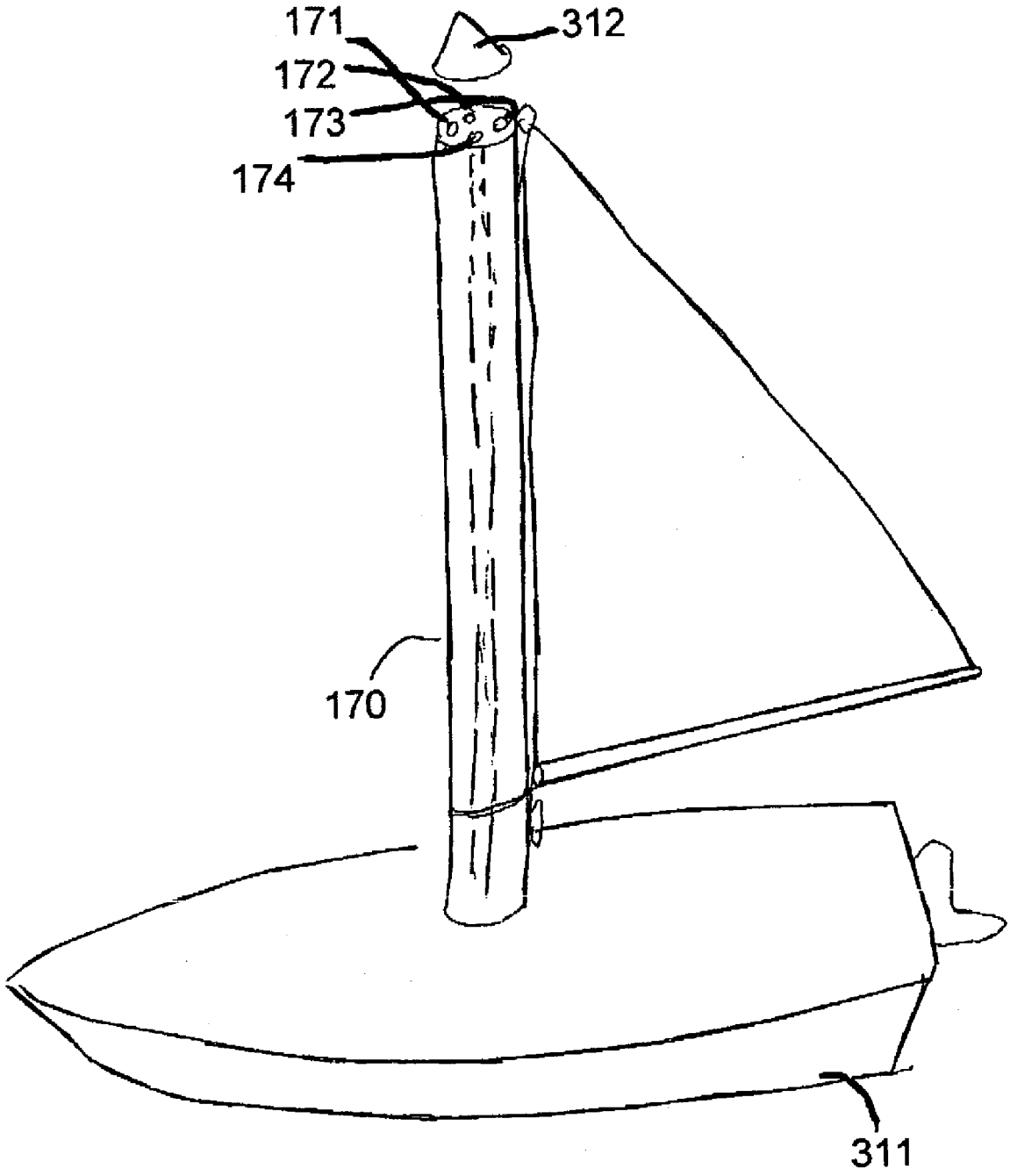
FIG. 31 depicts a sailboat having a mast using multiple tubular structural members.

FIG. 30 depicts a mast 170 of a sail boat 311. The mast is topped by a cap 312. The mast employs four tubular structural members 171, 172, 173, 174. The four tubular structural members are arranged so as provide stiffness to the mast in all directions. FIG. 17 depicts the arrangement of four tubular structural members 171, 172, 173, 174 within the body of the mast 170. Each of the four tubular structural members has a flexural axis. Each of the tubular structural members are inserted into a cavities 175, 176, 177, 178. The cavities have an inner diameter that matches the outer diameter of the tubes. In this embodiment, because the tubes are shaped, the inner diameter of the cavity matches the greatest outer diameter of the tubular structural members. The orientation of the four tubular structural members are arranged in order to evenly distribute the directional stiffness of the four tubular structural members within the mast 170 so that the mast 170 has a stiffness profile that is consistent regardless of the direction force is applied to the mast 170. The orientation is relative to the center of the device. FIG. 17 depicts the device with the four tubular structural members arranged so as to provide maximum stiffness to the device. In this orientation, the stiff axes intersect outside the mast. FIG. 18 depicts the four tubular structural members arranged so that they provide the minimum stiffness to the device. In this orientation, the stiff axes of the tubular structural members intersect directly in the center of the mast. The cap 312 can contain a device to orient the tubular structural members. The cap 312 can also simply be a mechanism to lock the tubular structural members into place. In other embodiments, the device can be located at the base of the mast, to provide the user with easier, on the fly access to the adjusting mechanism. While FIG. 31 depicts a mast having four tubular structural members, any multiple can be used.

Figure 19:
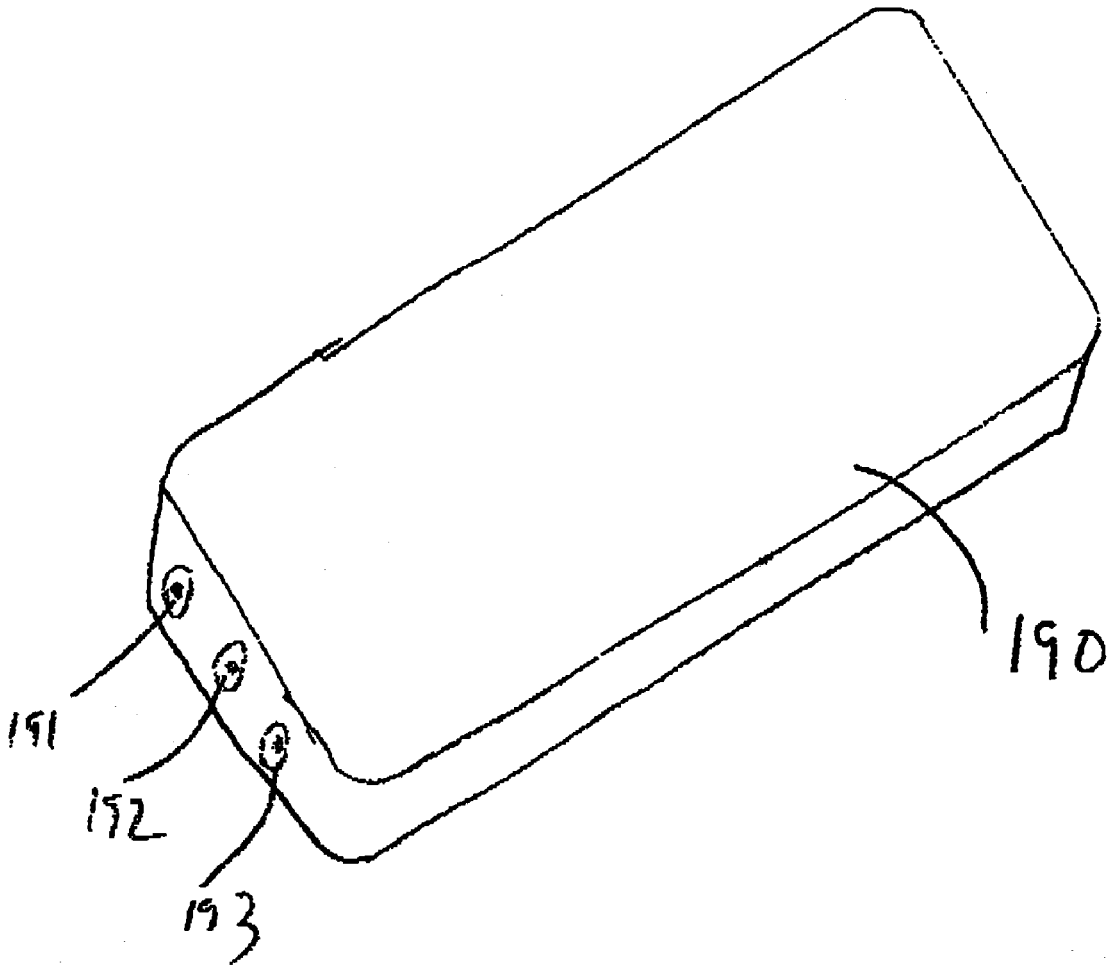
FIG. 19 depicts a resilient panel employing multiple tubular structural members.

Another embodiment of tubular structural member can be employed in weight lifting systems. In certain embodiments, the tubular structural member can be installed into an exercise apparatus that employs a resilient panel. The tubular structural member can be controlled so as to change the weight like resistance offered to the user during the exercise. FIG. 19 depicts a resilient panel 190 employing three tubular structural members 191, 192, 193. The orientation of each tubular structural member can be controlled so as to rotate during use or between uses. The tubular structural members may also be permanently aligned.

Figure 22:
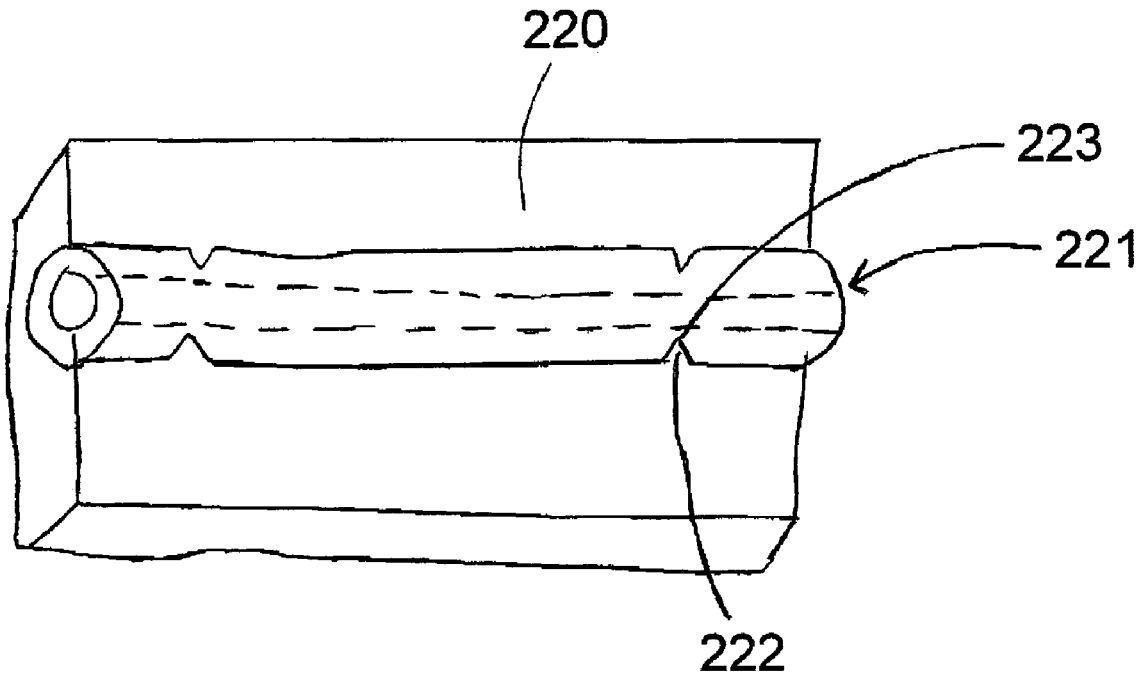
FIG. 22 depicts a device having a tubular structural member held in place by indentations.

Embodiments of devices utilizing a tubular structural member can have locating surfaces within the cavity and on the surface of the tubular structural member. These locating surfaces hold the tubular structural member in place and prevent translation of the tubular structural member. FIG. 22 depicts a resilient panel 220 housing a tubular structural member 221. The cavity is indented so that its inner diameter decreases at a point 222 while the tubular structural member has a similar point 223 where the outer diameter similarly decreases to match the cavity. The indentation prevents longitudinal movement of the tubular structural member.

In one embodiment, the tubular structural members would be rotated to and secured in the desired stiffness position. In other embodiments, motors, timers, computers, and the like are employed to rotate the tubular structural members. The use of the motors make changes to device stiffness automatic and eliminate the need for the user to effect a manual change of stiffness adjustment. Accordingly, the device can change resistance during the exercise without requiring the exercise to stop. The computer can also be connected to a display to indicate the amount by which the tubular structural members are rotated.

Other embodiments can be used to effectively control the rotation of the tubular structural members. FIG. 23 demonstrates the effect of rotating the tubular structural members. Rotating the tubular structural members effectively changes the moment of inertia and thus the stiffness on the resilient panel resistance of the resilient panel. Likewise, when the tubular structural member is inserted into a device or structure, the flexural resistance or stiffness of the device or structural will also change depending on the orientation of the tubular structural member.

Sports equipment and devices fitted with tubular structural members can be manufactured according to several embodiment methods. One embodiment of a manufacturing method has the step of permanently fixing the tubular structural member into a set position. Another embodiment for manufacturing the tubular structural member employs steps of machining the tubular structural member so that the variable stiffness can be varied in one direction, in two dimensions, or even in three dimensions. Other manufacturing embodiments include arranging numerous tubular structural member in order to allow for changes in stiffness in many directions at once.

Figure 28:
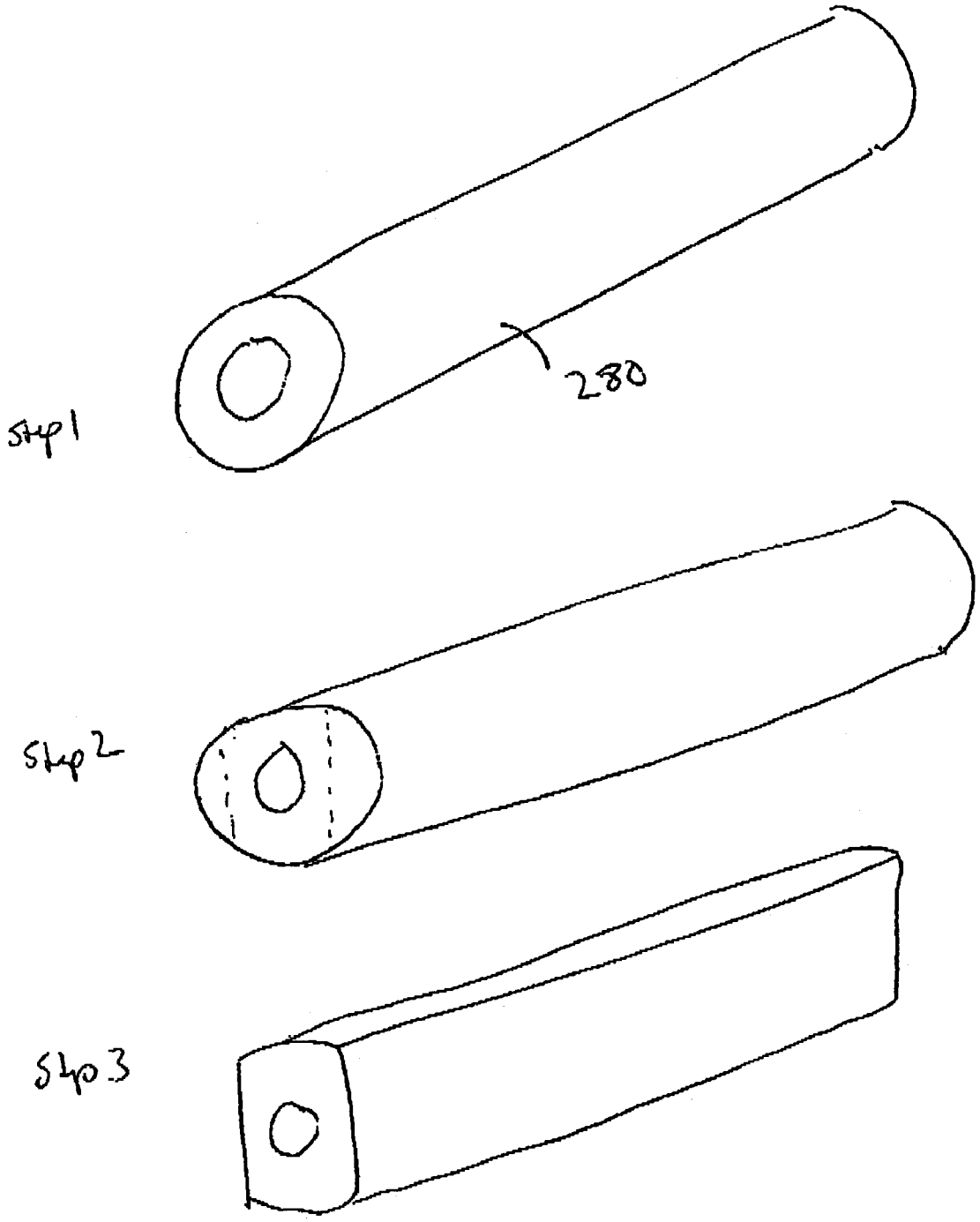
FIG. 28 depicts a tube having material removed along its longitudinal axis.

One embodiment of a method of manufacture has the tubular structural member constructed by machining a tube so as to remove material from the outer diameter. The material can be removed so as to leave slots or grooves in the tube. FIG. 30*a* shows a tubular structural member where material has been removed 295 to form cutouts or slots. FIG. 30*b* shows the same tubular structural member viewed from a 90° angle and showing the spine 296 created by the removal of material 295. Another method can be to remove enough material so as to introduce a spine shape to the tube as shown in FIG. 28. The tube 280 has material removed from two opposing sides so as to make the tube into a tubular structural member. In step 2, the dashed lines indicate material to be removed. Step 3 illustrates the tubular structural member after the material has been removed. The tubular structural member can be constructed by cutting lengths from a longer tube. These lengths can then be machined.

Tubular structural members can be manufactured in many different ways. The tubular structural member can be die formed, extruded or mandrel wrapped. Slots or grooves can be formed in place at the time of manufacturing or can be machined into place later. The tubular structural members can be individually cut from a longer tubular structural member. The tubular structural member can also be manufactured with reinforcing fibers When a device or structure utilizing the tubular structural member is constructed, the cavity can first be machined so as to match the outer diameter of the tubular structural member to within a certain tolerance. The tubular structural member is then inserted into the cavity. At this time, the tubular structural member may be arranged in the desired radial orientation. A device for holding the tubular structural member in place in the cavity can then be applied. This device can allow for the user to rotate the tubular structural member. In some embodiments, the tubular structural member will be simply glued into place, so as to achieve a permanent orientation. For example, the tubular structural member can be set using an ionomer (a polymer that once melted, raises its melting point). In other embodiments, the tubular structural member will be glued into place by glue that can allow the tubular structural member to be reset in its orientation. For example, the glue can be melted and the tubular structural member reorientated.

In other embodiments of devices or structures that utilize tubular structural members, more than one cavity has to be provided. In addition, each tubular structural member has to be orientated with respect to the other. When employing a capping device that will allow for future adjustment of the tubular structural members, the capping device can be designed so as to rotate all the tubular structural members with respect to each other so as to maintain an ideal alignment. However, multiple tubular structural member devices or structures can be permanently fixed in place.

The tubular structural member can be made in the same manner and using the same materials as used to fabricate fiberglass or composite golf club shafts. This involves the use of a tool or mandrel around which resin impregnated fiber or graphite cloth is wrapped and then cured. The mandrel can have indentations or protrusions that provide for more or less resin impregnated material in predetermined locations. The cured tube can be machined to a predetermined outer diameter to provide a precise fit when inserted into a sports equipment cavity. The machining can also be used to remove material in predetermined locations of the tube so as to create areas of greater or less thickness and result in more or less stiffness.

Another method of fabricating the tubular structural member can utilize the extrusion of material such as polyethylene, polyvinyl chloride or other ionomers as well as aluminum, steel and titanium from a molten state through a form and into a tubular shape. The tubular shape can be extruded in a shape to have areas of greater or less thickness and result in more or less stiffness. Reinforcing fibers or other materials can be incorporated into the process as another means of providing more or less stiffness in predetermined locations of the tube.

Another method of fabricating the tubular structural member can use the same materials and manner of fabrication as used to make steel or aluminum ski poles and golf shaft. This involves the use of a tool or mandrel around which steel or aluminum is formed. The tube can then be machined to remove material or further formed in predetermined locations of the tube so as to create areas of greater or less thickness or geometry changes and result in more or less stiffness.

Another method of fabricating the tube can utilize injection molding of material to create the tube, whereby ionomers or thermoplastic materials are introduced into a mold assembly. The mold assembly can be designed to provide a finished tube where there are areas of greater or less thickness, deliberate voids of material, or indentations or protrusions are created and result in more or less stiffness.

In each of the embodiments, the materials of the tubular structural member may be fabricated of any material having desired flexibility and stiffness characteristics. Such materials include, but are not limited to, metals, woods, rubber, thermoplastic polymers, thermoset polymers, ionomers, and the like. The thermoplastic polymers include the polyamide resins such as nylon; the polyolefins such as polyethylene, polypropylene, as well as their copolymers such as ethylene-propylene; the polyesters such as polyethylene terephthalate and the like; vinyl chloride polymers and the like, and the polycarbonite resins, and other engineering thermoplastics such as ABS class or any composites using these resins or polymers. The thermoset resins include acrylic polymers, resole resins, epoxy polymers, and the like. Polymeric materials may contain reinforcements that enhance the stiffness or flexure of tubular structural member. Some reinforcements include fibers such as fiberglass, metal, polymeric fibers, graphite fibers, carbon fibers, boron fibers and the like.

We claim:

1. A tubular structural member, comprising:

a tube having a longitudinal axis, a flexural axis, and a stiff axis, where the flexural axis and the stiff axis extend radially away from the longitudinal axis and the tube has a flexural resistance that is greatest in a direction parallel to the flexural axis; and a tube wall having an outer diameter that is tapered along the longitudinal axis.

2. The tubular structural member of claim 1, wherein the tube wall comprises a high flexural resistance material and a low flexural resistance material arranged so that the composite flexural resistance of the tubular structural member is greatest in a direction parallel to the flexural axis.

3. The tubular structural member of claim 1, wherein the tube wall has a wall thickness that is greatest where the tube wall intersects with the flexural axis and where the wall thickness is least in a direction parallel to the stiff axis.

4. The tubular structural member of claim 1, wherein:

the tube wall comprises at least two materials, the at least two materials each have a different flexural stiffness, and the at least two materials are arranged so that the tubular structural member has a flexural stiffness that greatest in a direction parallel to the flexural axis.

5. The tubular structural member of claim 1, wherein the tube wall comprises a step down point and a large tube section and a small tube section, where the large tube section has an outer diameter greater than the outer diameter of the small tube section, and the small tube section and large tube section meet at the step down point.

6. The tubular structural member of claim 1, wherein:

the tube comprises a large end and, a small end, the tube wall having at least one step down point and at least two tube sections, the at least two tube sections each having an outer diameter, the at least two tube sections arranged consecutively along the longitudinal axis so that the outer diameters of each of the at least two tube sections decrease from a large diameter end to a small diameter end, and the at least two tube sections meet at the at least one step down point.

7. The tubular structural member of claim 1, further comprising a device having a longitudinal axis and a cavity having an inner diameter that matches the tube wall outer diameter along the tube longitudinal axis, where the tubular structural member is inserted into the cavity.

8. A tubular structural member, comprising:

a tube having a longitudinal axis, a flexural axis, and a stiff axis, where the flexural axis and the stiff axis extend radially away from the longitudinal axis and the tube has a flexural resistance that is greatest in a direction parallel to the flexural axis;

a tube wall having an outer diameter; and a device having a longitudinal axis and a cavity along the device longitudinal axis having an inner diameter that matches the tube wall outer diameter along the longitudinal axis of the tubular structural member, where the tubular structural member is inserted into the cavity, the tubular structural flexural axis is aligned radially within the device so as to provide the device with flexural resistance, wherein the tubular structural member is fixed in the cavity so as to maintain the alignment between the device bending plane and the tube flexural axis, wherein the tubular structural member is fixed within the cavity by an adhesive.

9. The tubular structural member of claim 1, wherein the tube is filled with a non-structural foam.

10. The tubular structural member of claim 1, wherein the tube wall has an area delining slots therein arranged along Opposing sides of the tube wall to have the flexural resistance greatest in a direction parallel to the flexural axis.

11. The tubular structural member of claim 7, wherein the cavity has at least one indentation extending radially outward and the tubular structural member has at least one protrusion extending radially outward, so that the at least one protrusion and at least one indentation are located at the same point along the longitudinal axis of the tubular structural member.

12. The tubular structural member of claim 7, wherein:

the cavity is a tapered cavity, the tapered cavity having at least one protrusion extending radially inwards, the tubular structural member is tapered and has at least one indentation radially inward, and the at least one protrusion and at least one indentation are located at the same point along the longitudinal axis of the shaft.

* * * * *